US009384744B2

(12) United States Patent
Asami et al.

(10) Patent No.: US 9,384,744 B2
(45) Date of Patent: Jul. 5, 2016

(54) AUDIO SIGNAL CODING DEVICE AND AUDIO SIGNAL CODING METHOD

(71) Applicant: SOCIONEXT INC., Yokohama, Kanagawa (JP)

(72) Inventors: Mari Asami, Kawasaki (JP); Tomoya Fujita, Sagamihara (JP); Jun Ono, Kawasaki (JP); Shusaku Ito, Fukuoka (JP); Yoshiteru Tsuchinaga, Fukuoka (JP); Miyuki Shirakawa, Fukuoka (JP); Sosaku Moriki, Fukuoka (JP)

(73) Assignee: Socionext Inc., Yokohama (JP)

( * ) Notice: Subject to any disclaimer, the term of this patent is extended or adjusted under 35 U.S.C. 154(b) by 614 days.

(21) Appl. No.: 13/686,644

(22) Filed: Nov. 27, 2012

(65) Prior Publication Data

US 2013/0218576 A1 Aug. 22, 2013

(30) Foreign Application Priority Data

Feb. 17, 2012 (JP) ..... 2012-032594

(51) Int. Cl.

| | |
|---|---|
| ***G10L 19/00*** | (2013.01) |
| ***G10L 19/02*** | (2013.01) |
| ***G10L 19/032*** | (2013.01) |

(52) U.S. Cl.

CPC ..... *G10L 19/02* (2013.01); *G10L 19/032* (2013.01)

(58) Field of Classification Search

CPC ..... G10L 19/35; G10L 21/38; G10L 19/32; G10L 19/38; G10L 25/18; H04N 19/10; H04N 19/146

USPC ..... 704/9, 500, 230, 229, 220; 702/174; 382/233; 381/98, 107; 375/243, 375/240.03; 367/44; 341/200

See application file for complete search history.

(56) References Cited

U.S. PATENT DOCUMENTS

| | | | | |
|---|---|---|---|---|
| 4,312,050 | A * | 1/1982 | Lucas | 367/44 |
| 4,967,384 | A * | 10/1990 | Molinar et al. | 702/174 |
| 5,661,822 | A * | 8/1997 | Knowles et al. | 382/233 |
| 6,098,039 | A * | 8/2000 | Nishida | 704/229 |
| 6,678,653 | B1 * | 1/2004 | Tsushima et al. | 704/220 |
| 6,725,192 | B1 * | 4/2004 | Araki | 704/230 |
| 7,620,545 | B2 * | 11/2009 | Chiu et al. | 704/229 |

(Continued)

FOREIGN PATENT DOCUMENTS

| | | | |
|---|---|---|---|
| JP | 2007-293118 | A | 11/2007 |
| JP | 2008-065162 | A | 3/2008 |

OTHER PUBLICATIONS

International Standard, "ISO/IEC 11172-3 Part 3: Audio", First Edition, Aug. 1, 1993.

(Continued)

*Primary Examiner* — Michael Colucci
(74) *Attorney, Agent, or Firm* — Arent Fox LLP

(57) ABSTRACT

An audio signal coding device divides a frequency spectrum obtained from an input digital signal to a plurality of bands, scales and quantizes divided frequency spectra based on a scalefactor of each of the bands and a common scale which is common to the plurality of bands, and codes quantized frequency spectra. The audio signal coding device includes a band number determination unit configured to calculate a number of coding bands for coding the quantized frequency spectra, and a common scale estimation unit configured to estimate the common scale in accordance with the number of coding bands.

10 Claims, 25 Drawing Sheets

(56) References Cited

U.S. PATENT DOCUMENTS

| | | | | |
|---|---|---|---|---|
| 7,996,234 | B2 * | 8/2011 | Dieterich et al. | 704/500 |
| 2001/0050959 | A1 * | 12/2001 | Nishio et al. | 375/243 |
| 2003/0088423 | A1 * | 5/2003 | Nishio et al. | 704/500 |
| 2006/0104351 | A1 * | 5/2006 | Teng | 375/240.03 |
| 2008/0065376 | A1 | 3/2008 | Osada | |
| 2009/0083042 | A1 * | 3/2009 | Suwabe | 704/500 |
| 2010/0023334 | A1 * | 1/2010 | Eguchi | 704/500 |
| 2011/0170711 | A1 * | 7/2011 | Rettelbach et al. | 381/98 |
| 2012/0039490 | A1 * | 2/2012 | Smithers | 381/107 |
| 2012/0146831 | A1 * | 6/2012 | Eksler | 341/200 |

OTHER PUBLICATIONS

International Standard, "ISO/IEC 13818-7 Part 7: Advanced Audio Coding (AAC)", Fourth Edition, Jan. 15, 2006.

Partial Japanese Office Action issued on Sep. 29, 2015; Japanese Application No. 2012-032594.

* cited by examiner

X-th LOOP (X+1)th LOOP

FIG.15

| VARIABLES | CONTENTS |
|---|---|
| $x_{in}()$ | INPUT DIGITAL SIGNA |
| scalefactor() | SCALEFACTOR (52 GROUP IN TOTAL) |
| mdct() | MDCT SPECTRUM (1024 SPECTRA IN TOTAL) |
| spectral_energy() | SPECTRUM ELECTRIC POWER OF SCALEFACTOR BAND |
| masking_threshold() | MASKING THRESHOLD (52 GROUP IN TOTAL) |
| quant() | QUANTIZATION VALUE |
| common_scale | COMMON SCALE |
| band | THE NUMBER OF CODING BANDS |
| ⊿scale | DELTA SCALE AMOUNT |
| usable__bit | THE NUMBER OF USABLE BITS FOR QUANTIZATION |
| quant_bit | THE NUMBER OF QUANTIZATION BITS |
| sfb | SUBBAND NUMBER(0 TO 51) |
| k | FREQUENCY INDEX(0 TO 1023) |
| n | SAMPLE NUMBER |
| $\alpha$ | QUANTIZATION BIT REDUCTION CHARACTERISTIC |

FIG.20

| VARIABLES | CONTENTS |
|---|---|
| $x_{in}()$ | INPUT DIGITAL SIGNAL |
| scalefactor() | SCALEFACTOR (52 GROUP IN TOTAL) |
| mdct() | MDCT SPECTRUM (1024 SPECTRA IN TOTAL) |
| spectral_energy() | SPECTRUM ELECTRIC POWER OF SCALEFACTOR BAND |
| masking_threshold() | MASKING THRESHOLD (52 GROUP IN TOTAL) |
| quant() | QUANTIZATION VALUE |
| common_scale | COMMON SCALE |
| band | THE NUMBER OF CODING BANDS |
| ⊿scale | DELTA SCALE AMOUNT |
| usable_bit | THE NUMBER OF USABLE BITS FOR QUANTIZATION |
| quant_bit | THE NUMBER OF QUANTIZATION BITS |
| sfb | SUBBAND NUMBER(0 TO 51) |
| k | FREQUENCY INDEX(0 TO 1023) |
| n | SAMPLE NUMBER |
| $\alpha$ | QUANTIZATION BIT REDUCTION CHARACTERISTIC |

AUDIO SIGNAL CODING DEVICE AND AUDIO SIGNAL CODING METHOD

CROSS-REFERENCE TO RELATED APPLICATION

This application is based upon and claims the benefit of priority of the prior Japanese Patent Application No. 2012-032594, filed on Feb. 17, 2012, the entire contents of which are incorporated herein by reference.

FIELD

The embodiments discussed herein are related to an audio signal coding device and an audio signal coding method.

BACKGROUND

In recent years, a high efficiency coding is performed in order to compress and transmit an audio (voice) signal efficiently. An algorithm for such audio compression is standardized, for example, by MPEG (Moving Picture Expert Group).

The audio compression algorithm of MPEG is known as MPEG2 AAC (MPEG2 Advanced Audio Codec: "ISO/IEC 13818-7 Part7: Advanced Audio Coding (AAC)") and MP3 (MPEG1 Audio Layer 3: "ISO/IEC 11172-3 Part3: Audio") and so on.

MPEG 2 AAC has been broadly applied, for example, to ISDB standard for BS digital broadcasting and terrestrial digital broadcasting in Japan, AAC format for SD-Audio, and DVB (Digital Video Broadcasting) in the Europe bloc, and so on.

In quantization process of coding algorithm of AAC, repetitive loop processes which are referred to as an inner loop and an outer loop are performed to satisfy given bit rate (the number of usable bits for quantization).

In inner loop, scalefactor is controlled to adjust quantization granularity so that quantization error is masked based on human's auditory property. In outer loop, in order to control overall code amount, common scale (common scale value) is controlled to adjust quantization granularity of overall frame.

Such two kinds of values for determining quantization granularity (scalefactor and common scale) may have a large influence on coding quality, and therefore inner loop and outer loop are demanded to be controlled at the same time efficiently, correctly.

For example, written standards (ISO/IEC 13818-7) of MPEG-2 AAC introduce a manner of controlling scalefactor and common scale arbitrarily at the time of quantization. Outer loop (bit control loop) for controlling common scale changes, for example, common scale by one quantization step at a time, and repeats loop until the number of quantization bits is equal to or less than the number of usable bits for quantization.

However, when bit control loop is repeated while common scale is changed by one step at a time, it is difficult to complete quantization process within a short time. Addressing such problem, there was an attempt at estimating common scale by which the number of quantization bits becomes equal to or falls under target value, based on actual result value of quantization bit. However, it is difficult to obtain target common scale within a short time due to various factors.

In the related art, there have been proposed various kinds of audio signal coding devices and audio signal coding methods.

Patent Document 1: Japanese Laid-open Patent Publication No. 2008-065162

Non-Patent Document 1: INTERNATIONAL STANDARD, "ISO/IEC 13818-7 Part 7: Advanced Audio Coding (AAC)," Fourth edition, 2006-01-15

Non-Patent Document 2: INTERNATIONAL STANDARD, "ISO/IEC 11172-3 Part 3: Audio," First edition, 1993-08-01

SUMMARY

According to an aspect of the embodiments, there is provided an audio signal coding device which divides a frequency spectrum obtained from an input digital signal to a plurality of bands, scales and quantizes divided frequency spectra based on a scalefactor of each of the bands and a common scale which is common to the plurality of bands, and codes quantized frequency spectra.

The audio signal coding device includes a band number determination unit configured to calculate a number of coding bands for coding the quantized frequency spectra, and a common scale estimation unit configured to estimate the common scale in accordance with the number of coding bands.

The object and advantages of the embodiments will be realized and attained by the elements and combinations particularly pointed out in the claims.

It is to be understood that both the foregoing general description and the following detailed description are exemplary and explanatory and are not restrictive of the embodiments, as claimed.

BRIEF DESCRIPTION OF DRAWINGS

FIG. 15 is a drawing for describing variables and contents of the variables, used by the quantization processing unit illustrated in FIG. 14;

FIG. 20 is a drawing for describing variables and the contents of the variables, used by the quantization processing unit illustrated in FIG. 19;

DESCRIPTION OF EMBODIMENTS

Before describing the embodiments of an audio signal coding device and an audio signal coding method in detail, examples of audio signal coding devices and audio signal coding methods and those problems will be described with reference to FIG. 1 through FIG. 9.

Although the embodiments are described mainly using AAC (MPEG 2 AAC: ISO/IEC 13818-7) as examples in this specification, the present examples described below are not limited to applying to AAC. The present examples are also applicable to, for example, the quantization process of coding algorithms such as MP3.

Figure 1:
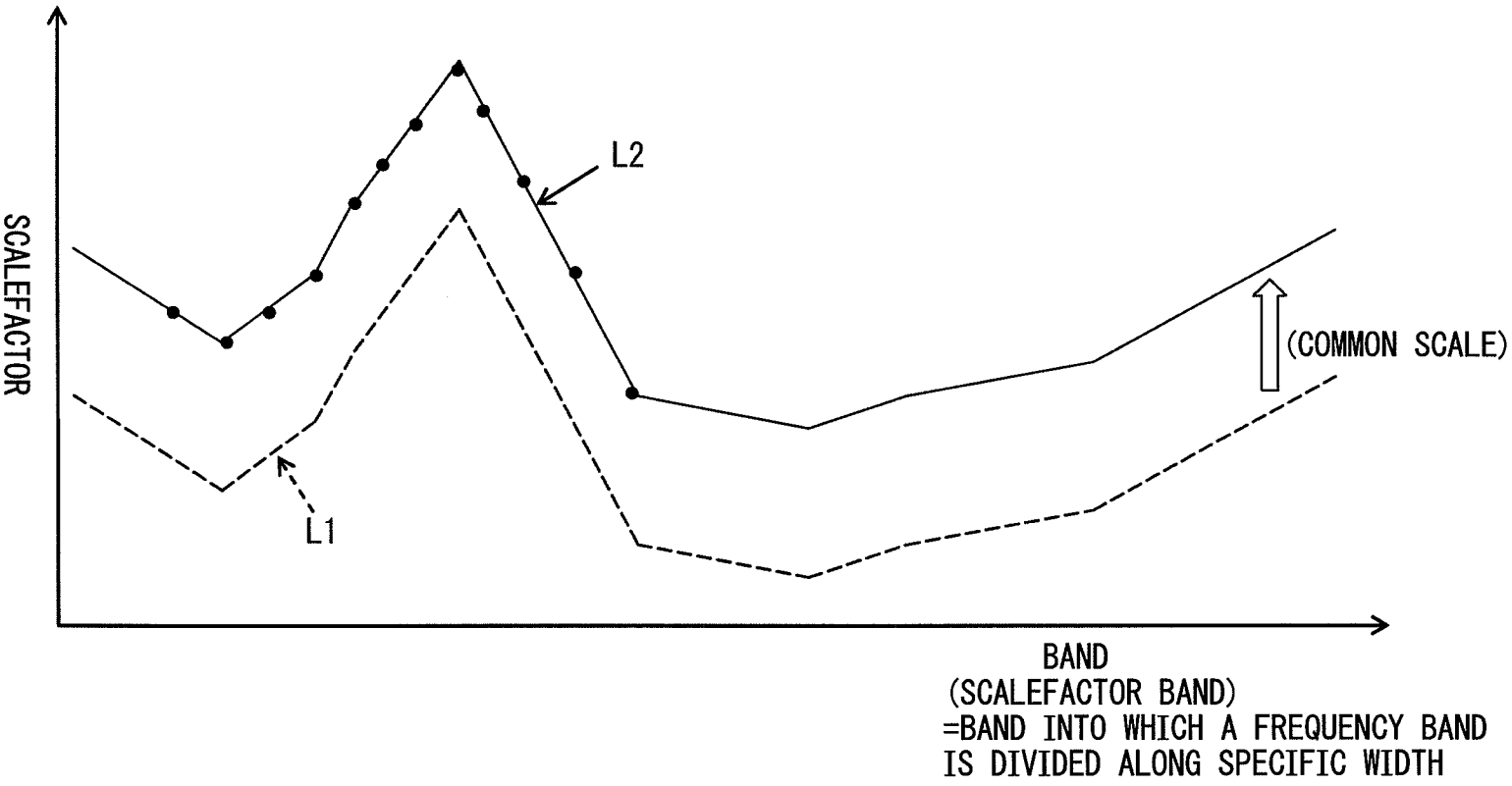
FIG. 1 is a drawing for describing a quantization loop.

FIG. 1 is a drawing for describing a quantization loop (a bit control loop (outer loop) in a quantization process of AAC coding algorithm). In other words, FIG. 1 illustrates the spectrum of each band, where a vertical axis of FIG. 1 represents a scalefactor (scale value) and a horizontal axis represents a band (the number of bands: scalefactor band).

In FIG. 1, the referential marks L1 (dashed line) and L2 (solid line) illustrate scalefactors set for each band. L1 corresponds to a calculation of an initial scale, and L2 is a scalefactor which is shifted from L1 by a common scale (Common Scale).

When the common scale to shift becomes larger, the quantization step size becomes coarser, and therefore the number of quantization bits decreases. Note that scalefactor bands (bands) are the bands into which a frequency band is divided along a specific width.

Adding a constant amount of the common scale to the spectrum of each band of the input audio signal, which is illustrated in the dashed line L1 of FIG. 1, this resulting in the solid line L2, reduces the number of quantization bits. As a result, finally, the number of quantization bits falls under the number of usable bits for quantization.

Figure 2A:
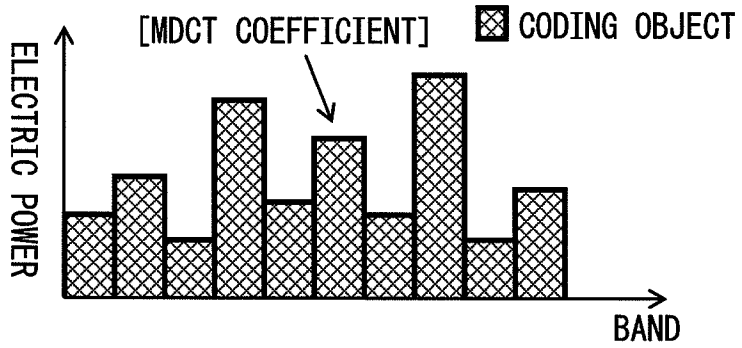
FIG. 2A, FIG. 2B, FIG. 2C, and FIG. 2D are drawings for describing a relation between a quantization loop and coding bands (the number of coding bands)
Figure 2B:
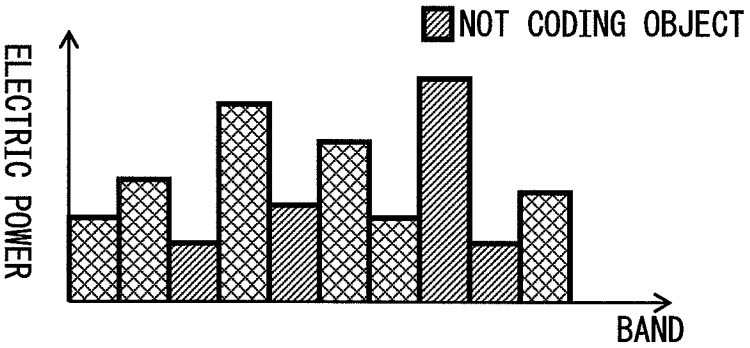
Figure 2C:
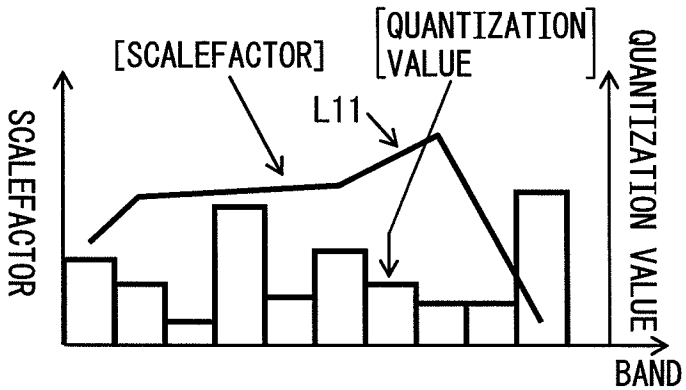
Figure 2D:
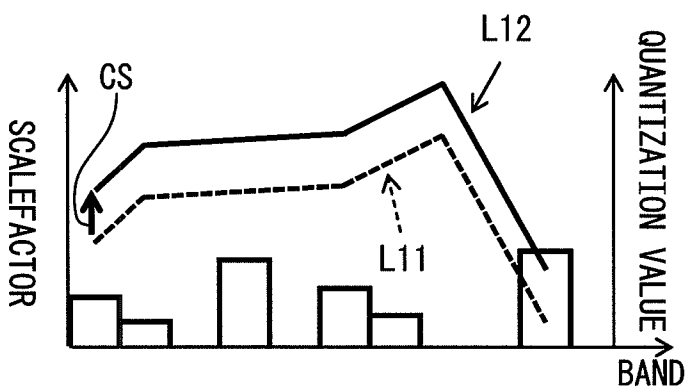

FIG. 2A, FIG. 2B, FIG. 2C, and FIG. 2D are drawings for describing a relation between a quantization loop and coding bands (the number of coding bands). FIG. 2A and FIG. 2B illustrate a relation between electric power and the band in X-th loop and (X+1)th loop. FIG. 2C and FIG. 2D illustrate a relation between the scalefactor and the band in X-th loop and (X+1)th loop.

For example, in a coding (AAC), MDCT (modified discrete cosine transform) coefficient is coded in accordance with the quantization value and the scalefactor. In other words, the quantization value is expressed by the following [formula 1].

$$\text{quantization value}=\text{int}(\text{mdct coefficient}^{3/4}\times 2^{-3/16\times scalefactor}) \quad \text{[formula 1]}$$

Therefore, when the value of the scalefactor increases, the quantization value approaches 0.

As is clear from a comparison of FIG. 2A with FIG. 2C, and a comparison of FIG. 2B with FIG. 2D, the spectrum L11 of X-th loop is shifted by the common scale CS in (X+1)th loop to be the spectrum L12.

In other words, as illustrated in the FIG. 2A and FIG. 2C, in X-th loop, all ten bands serve as coding objects, and are quantized, respectively. On the other hand, as illustrated in FIG. 2B and FIG. 2D, in (X+1)th loop, the number of non-coding object bands where quantization values will become "0" are four, and six remaining bands serve as the coding objects.

Thus, in the quantization process for an input audio signal (spectrum of each band), total number of bands (coding bands) to be coded may be changed for each quantization loop.

Figure 3:
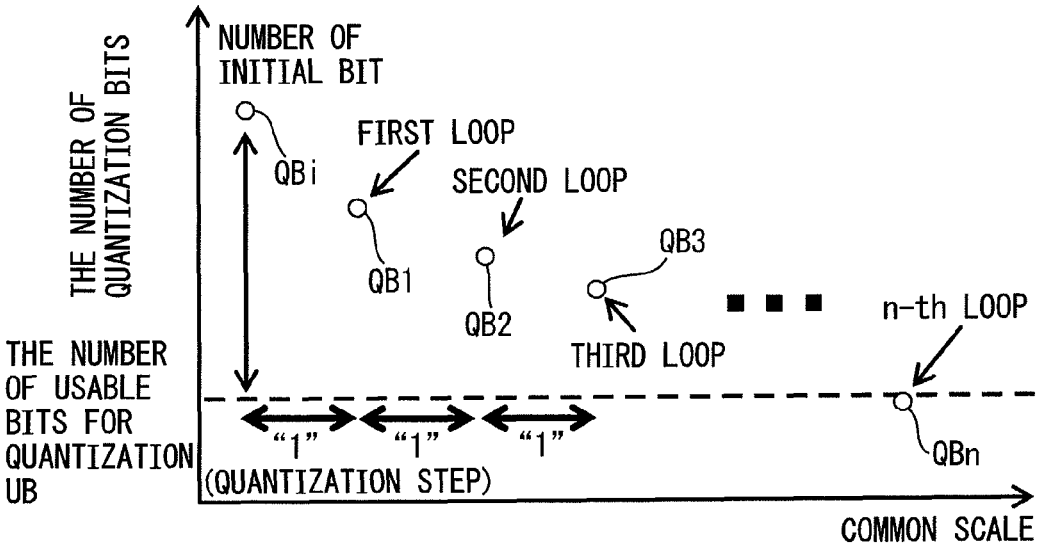
FIG. 3 is a drawing for describing an example of quantization process.
Figure 4:
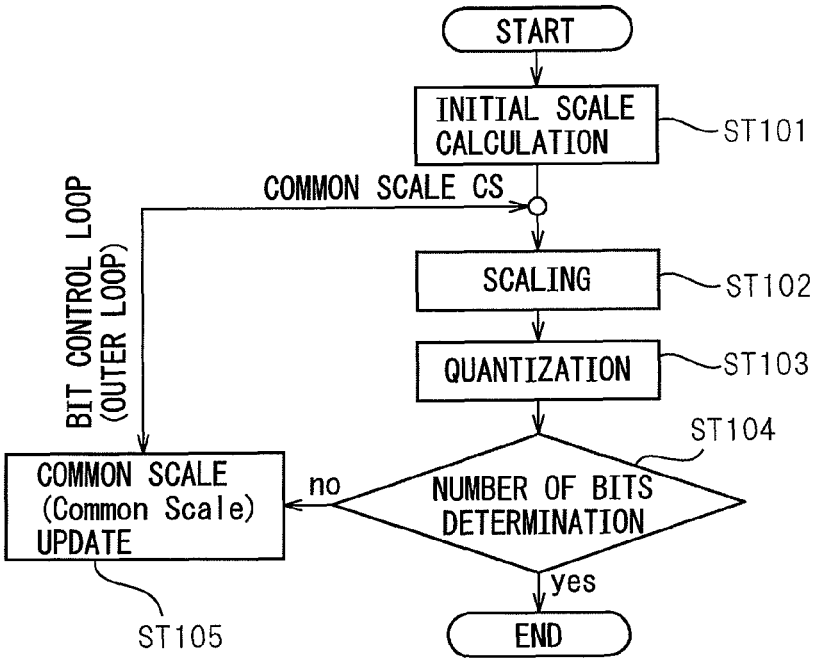
FIG. 4 is a flowchart for describing the quantization process illustrated in FIG. 3.

FIG. 3 is a drawing for describing an example of quantization process, and FIG. 4 is a flowchart for describing the quantization process illustrated in FIG. 3.

When the quantization process (AAC coding process) illustrated in FIG. 3 and FIG. 4 starts, the initial value of the scalefactor (hereinafter, also referred to as initial scale) is calculated in step ST101. Then, it proceeds to step ST102 to perform a scaling. The calculation of the initial scale corresponds to the dashed line L1 in FIG. 1, for example, as mentioned above.

Furthermore, it proceeds to step ST103 to perform a quantization. Accordingly, the number of quantization bits QB (quant bit) may be calculated, i.e. the number of initial bits QBi. Next, it proceeds to step ST104 to determine the number of bits. In other words, it is determined whether or not the number of initial bits QBi is equal to or less than the number of usable bits for quantization UB (usable bit).

When it is determined that the number of initial bits QBi does not equal to or less than the number of usable bits for quantization UB (QBi>UB) in step ST104, it proceeds to step ST105 to update the common scale (CS), and returns to step ST102 to repeat the subsequent process in the same manner.

In other words, when it is determined that QBi>UB in step ST104, the common scale is changed (increased) by one quantization step at a time in step ST105. Subsequent steps ST102 and ST103 are performed using the updated common scale CS.

According to the processes of steps ST102 and ST103 using the updated common scale CS, it obtains the number of quantization bits QB1 of first bit control loop, and determines the number of bits in step ST104 mentioned above.

When it is determined that QB1>UB in step ST104, it proceeds to step ST105 to further change the common scale by one quantization step at a time. Subsequent steps ST102 and ST103 are performed using the updated common scale CS.

FIG. 3 illustrates a situation in which the number of quantization bits QBn in n-th loop becomes equal to or falls below the number of usable bits for quantization UB. In other words, processes are repeated until it is determined that the number of quantization bits (QB: QBi, QB1 to QBn) after a loop process is equal to or less than the number of usable bits for quantization UB in step ST104. In step ST104, when it is determined that QBn≤UB, the value QBn is output and the process is finished.

Thus, the quantization process illustrated in FIG. 3 and FIG. 4 changes the common scale CS by one quantization step at a time, and the loop is repeated until the number of quantization bits QB becomes equal to or falls under the number of usable bits for quantization UB (QB≤UB).

Therefore, when the difference between the number of quantization bits QB and the number of usable bits for quantization UB is large, it is difficult to complete the quantization process within a short time by changing the common scale by one quantization step at a time.

Figure 5:
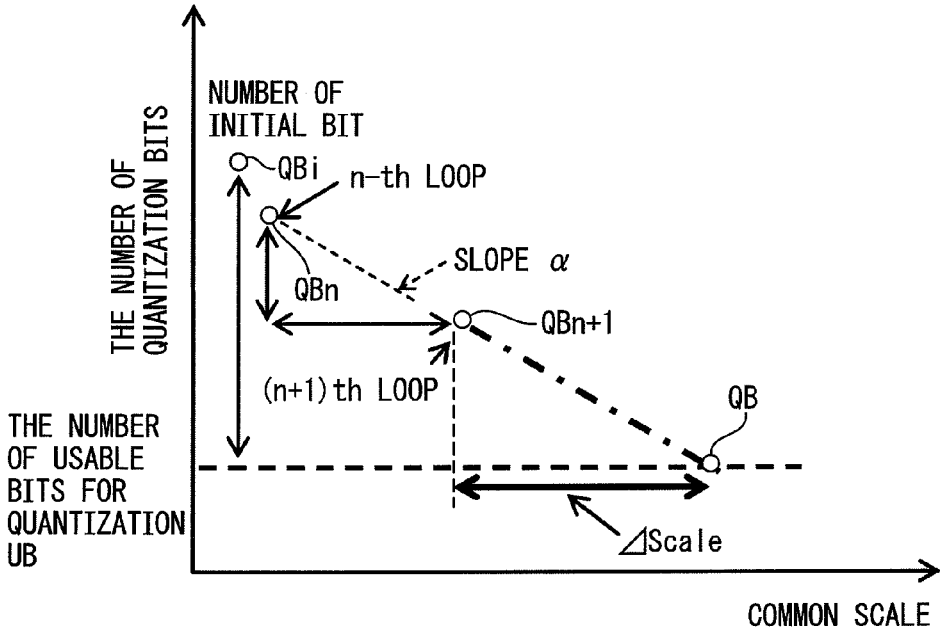
FIG. 5 is a drawing for describing another example of the quantization process.
Figure 6:
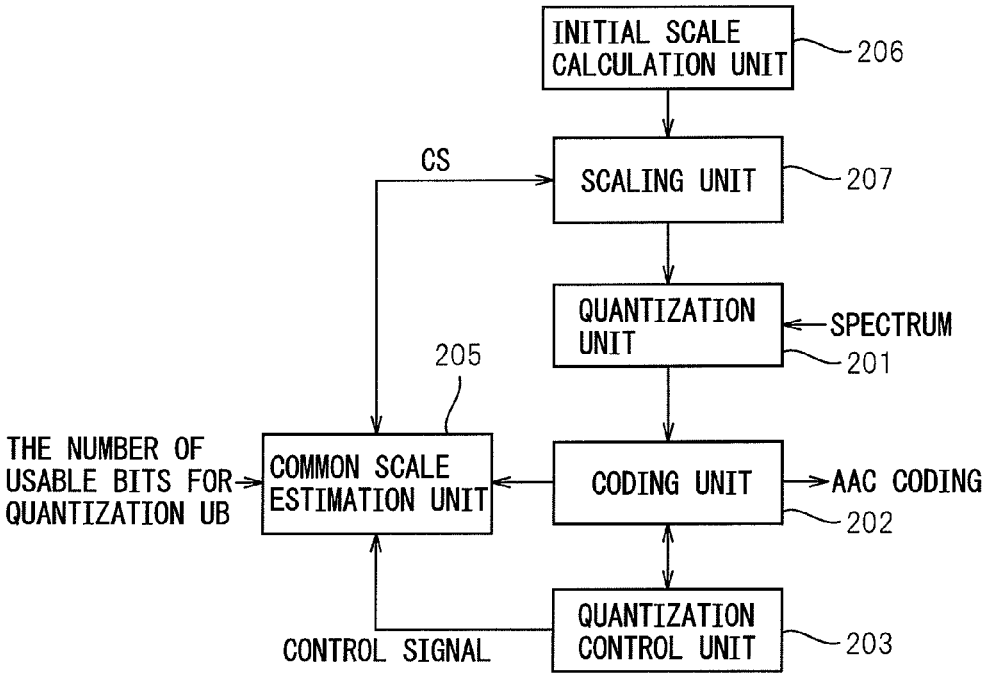
FIG. 6 is a block diagram illustrating an example of a quantization processing unit which realizes the quantization process illustrated in FIG. 5.
Figure 7:
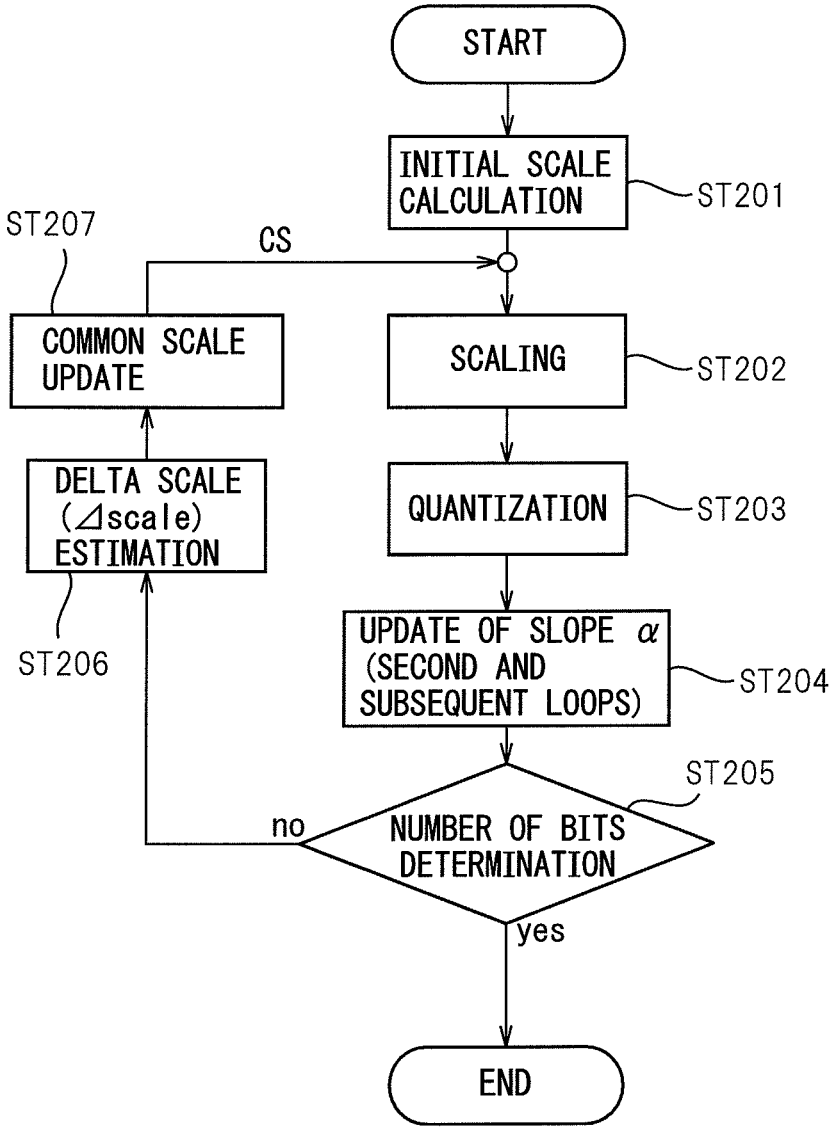
FIG. 7 is a flowchart for describing the quantization process illustrated in FIG. 5.

FIG. 5 is a drawing for describing another example of the quantization process, and FIG. 6 is a block diagram illustrating an example of a quantization processing unit which realizes the quantization process illustrated in FIG. 5. FIG. 7 is a flowchart for describing the quantization process illustrated in FIG. 5.

In FIG. 6, the referential mark 201 illustrates a quantization unit, 202 illustrates a coding unit, 203 illustrates a quantization control unit, 205 illustrates a common scale estimation unit, 206 illustrates an initial scale calculation unit, and 207 illustrates a scaling unit. Note that the output of the coding unit 202 and the output of the quantization control unit 203 are input into the common scale estimation unit 205.

When the quantization process (AAC coding process) illustrated in FIG. 5 to FIG. 7 starts, the initial scale calculation unit 206 calculates the initial scale in step ST201. It proceeds to step ST202, and the scaling unit 207 performs the scaling.

Furthermore, it proceeds to step ST203, and the quantization unit 201 performs quantization. Whereby, the number of initial bits QBi may be obtained. The spectrum (input audio signal) of each band is input into the quantization unit 201.

Next, it proceeds to step ST205, and determines the number of bits, i.e. determines whether or not the number of initial bits QBi is equal to or less than the number of usable bits for quantization UB. In a loop with the number of initial bits QBi, step ST204 is passed to proceed to step ST205. On the other hand in second and subsequent loops, step ST204 is performed by the coding unit 202 and the quantization control unit 203.

When it is determined that the number of initial bits QBi is not equal to or less than the number of usable bits for quantization UB (QBi>UB) in step ST205, it proceeds to step ST206 to estimate the value of ΔScale (an adding amount of the common scale). Furthermore, it proceeds to step ST207 to update the common scale.

The processes of steps ST204 through ST207 are performed by the coding unit 202, the quantization control unit 203, and the common scale estimation unit 205. Note that the number of usable bits for quantization UB is input into the common scale estimation unit 205.

In other words, in step ST205, when it is determined that QBi>UB, the processes of step ST202 and subsequent steps are repeated using the common scale CS updated in step ST207. In second loop and subsequent loops, the value of slope α is updated in step ST204, and it proceeds to the following step ST205.

For example, when the number of quantization bits QBn in n-th loop is larger than the number of usable bits for quantization UB, it is determined that QBn>UB in step ST205, and proceeds to step ST206.

When it is determined that QBn>UB in step ST205 in the quantization process illustrated in FIG. 5 through FIG. 7, the delta scale is estimated in step ST206 using QBn for the n-th loop, and the number of quantization bits QBn+1 for the next (n+1)th loop.

Specifically, as illustrated in FIG. 5, using the slope α obtained from QBn in n-th loop and QBn+1 in (n+1)th loop, the delta scale (ΔScale) is obtained by the following [formula 2] from the number of actual quantization bits QBn+1 in the (n+1)th loop and the number of usable bits for quantization UB.

$$\Delta\text{Scale} = \frac{\text{the number of actual quantization bits} - \text{the number of usable bits}}{\alpha} \quad \text{[formula 2]}$$

In other words, the value of ΔScale is calculated assuming that the slope α obtained from QBn for the n-th loop and QBn+1 for (n+1)th loop does not change, and processes of step ST202 and subsequent steps are performed using the common scale CS to which the value of ΔScale is added.

Then, when it is determined that QB≤UB in step ST205, the value QB is output as AAC coded data from the coding unit 202, and the process is finished.

Thus, the quantization process illustrated in FIG. 5 through FIG. 7 obtains, for example, the adding common scale (ΔScale) using the slope α obtained from an n-th actual result value QBn and an (n+1)th actual result value QBn+1 in the bit control loop, and uses the common scale CS updated by the adding common scale.

Figure 8:
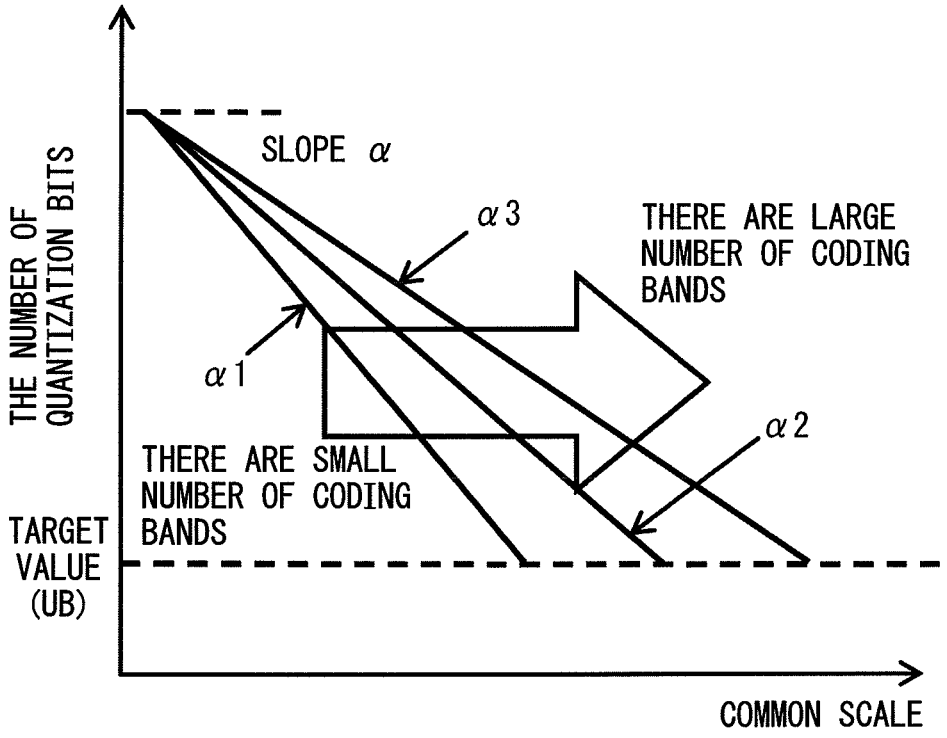
FIG. 8 is a drawing for describing a relation between the number of coding bands and common scale (scalefactor)
Figure 9:
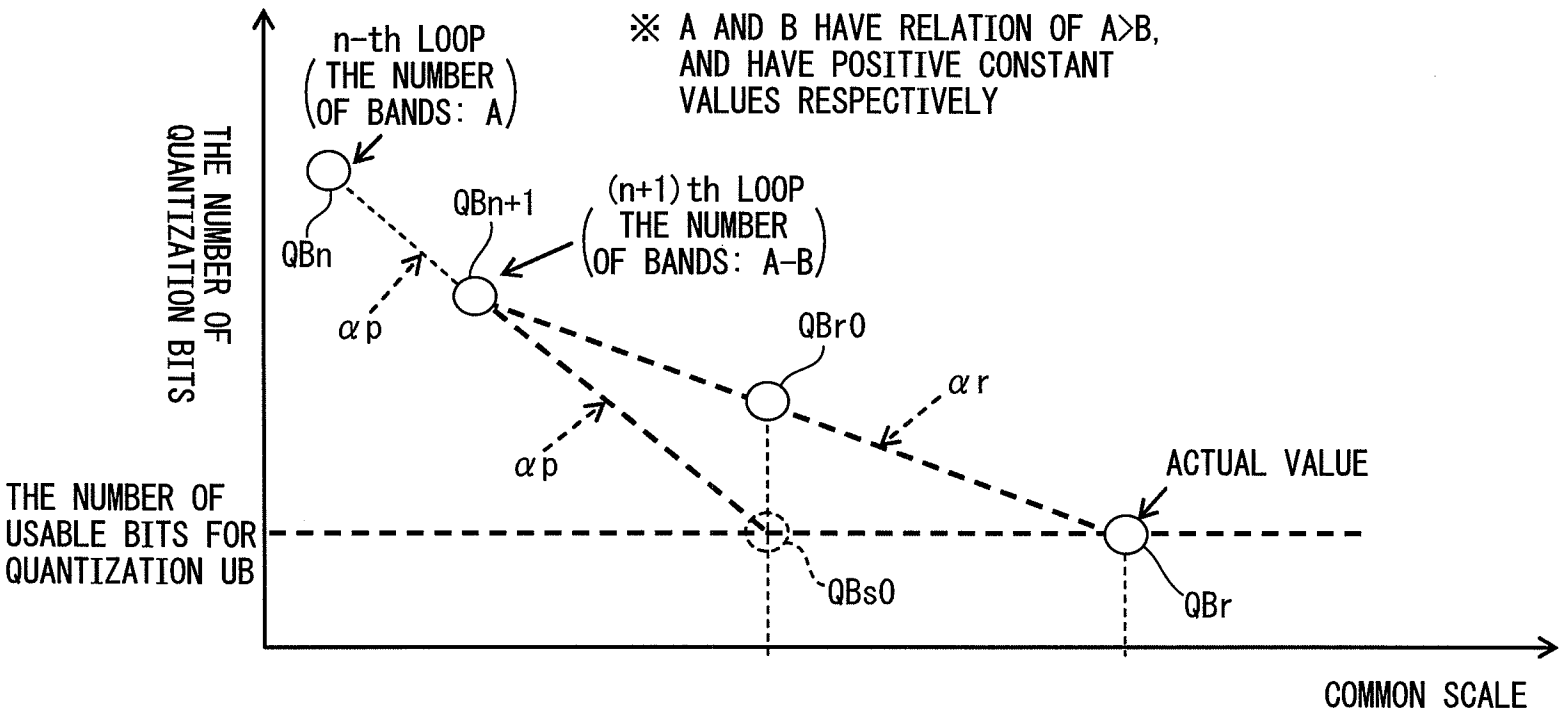
FIG. 9 is a drawing for describing problems in the quantization process described with reference to FIG. 5 to FIG. 7.

FIG. 8 is a drawing for describing a relation between the number of coding bands and a common scale (scalefactor) and, FIG. 9 is a drawing for describing problems in the quantization process described with reference to FIG. 5 to FIG. 7.

As illustrated in FIG. 8, the slope α mentioned above changes due to various factors. The slope is gentle such as α3 when there are large number of coding bands, and on the contrary, the slope is steep such as α1 when there are small number of coding bands. Note that the slope α2 corresponds to the number of coding bands which is between the number of coding bands of the slope α1, and the number of coding bands of the slope α3.

Now, as illustrated in FIG. 9, a situation will be assumed in which QBs is obtained so that QBs is equal to or less than the number of usable bits for quantization UB, using the slope αp obtained from QBn for n-th loop and QBn+1 for (n+1)th loop. For example, a situation will be assumed in which an actual slope is αr whereas the estimated slope is αp. It is also assumed that the number of bands for n-th loop is represented by A, the number of bands for (n+1)th loop is represented by A−B, and A, B have a relation of A>B and have positive constant values respectively.

At this time, quantization bit QBs0, which is obtained using the slope αp obtained from QBn for n-th previous loop and QBn+1 for (n+1)th loops, will be presented in a position of QBr0 when an actual slope is αr. Therefore, there is a large difference between the quantization bit QBs0 and the actual quantization bit value QBr to be obtained. This results in further repetition of the loop processes in order to complete the bit control loop.

In other words, it is difficult to obtain a suitable adding common scale (ΔScale) by using the previous reduction characteristic of the number of quantization bits. This is because the common scale CS and the number of coding bands have a correlation with the reduction characteristic (the slope α) of the number of quantization bits QB, and the number of coding bands changes when a scale (the common scale CS) changes. As a result, the reduction characteristic changes for each loop.

Thus, also in the quantization process illustrated in FIG. 5 through FIG. 7, there is a problem that it is difficult to complete the quantization process within a desired short time.

Below, embodiments of an audio signal coding device and an audio signal coding method will be explained in detail with reference to the attached drawings.

Figure 10:
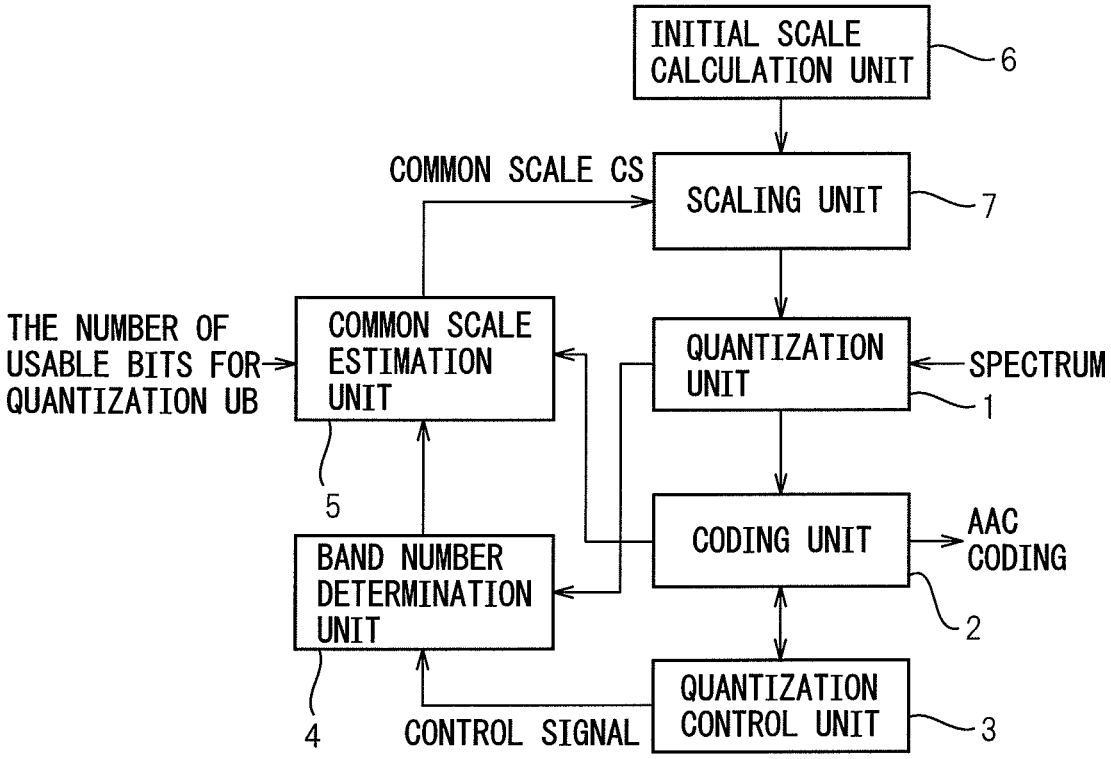
FIG. 10 is a block diagram illustrating an example of a quantization processing unit in an audio signal coding device of the present embodiment.
Figure 11:
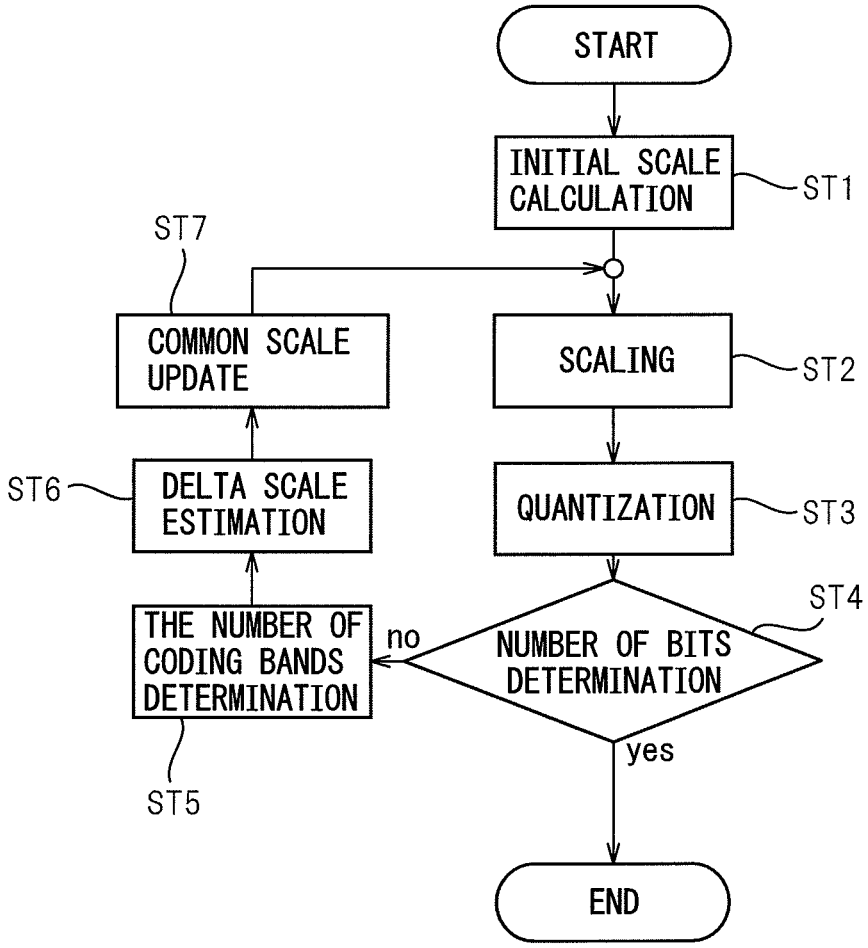
FIG. 11 is a flowchart for describing an example of a process executed by the quantization processing unit illustrated in FIG. 10.
Figure 12:
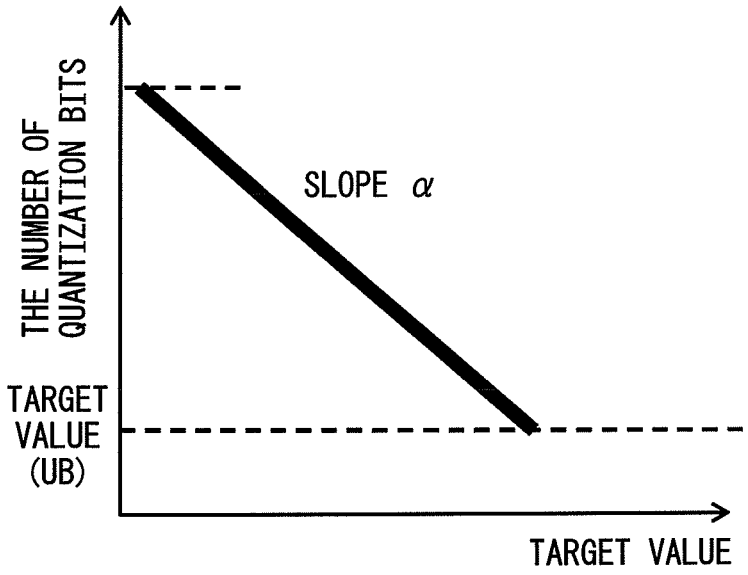
FIG. 12 is a drawing for describing a process of a slope in the quantization process of the present embodiment.

FIG. 10 is a block diagram illustrating an example of the quantization processing unit in the audio signal coding device of the present embodiment, and FIG. 11 is a flowchart for describing an example of a process executed by the quantization processing unit illustrated in FIG. 10. FIG. 12 is a drawing for describing a process of the slope in the quantization process of the present embodiment.

In FIG. 10, the referential mark 1 illustrates a quantization unit, 2 illustrates a coding unit, 3 illustrates a quantization control unit, 4 illustrates a band number determination unit, 5 illustrates a common scale estimation unit, 6 illustrates an initial scale calculation unit, and 7 illustrates a scaling unit.

The quantization unit 1 in FIG. 10 performs a process which is different from the process by the quantization unit 201 in FIG. 6 mentioned above. The output of the quantization unit 1 and the output of the quantization control unit 3 are input into the band number determination unit 4. Moreover, the output of the coding unit 2 and the output of the band number determination unit 4 are input into the common scale estimation unit 5.

As illustrated in FIG. 11, when the process (AAC coding process) in the quantization processing unit of the present embodiment starts, the initial scale calculation unit 6 calculates the initial scale in step ST1. It proceeds to step ST2, and the scaling unit 7 performs the scaling.

Furthermore, it proceeds to step ST3, and the quantization unit 1 performs the quantization. The processes of steps ST1 to ST3 correspond to the processes of steps ST101 to ST103 in FIG. 4 mentioned above and the processes of steps ST201 to ST203 in FIG. 7.

By this means, the number of initial bits (QBi) may be obtained. The quantization unit 1 inputs the signals with a plurality of bands into which the frequency spectrum obtained from the input digital signal (input audio signal) is divided. The output of the quantization unit 1 is input into the band number determination unit 4.

Next, it proceeds to step ST4, and determines the number of bits, i.e. determines whether or not the number of initial bits is equal to or less than the number of usable bits for quantization (UB). When it is determined that the number of initial bits is not equal to or less than the number of usable bits for quantization (QBi>UB) in step ST4, it proceeds to step ST5 to determine the number of coding bands.

Then, the delta scale is estimated in step ST6, and it proceeds to step ST7 to update the common scale. Note that the processes of steps ST5 to ST7 are performed by the band number determination unit 4 and the common scale estimation unit 5.

In other words, the band number determination unit 4 determines the number of coding bands. The number of coding bands is the number of bands of which amount of code changes according to the common scale CS. The common scale estimation unit 5 corrects the value acquired from the number of quantization bits to reduce and the reduction characteristic (slope α) by the number of coding bands, to calculate the adding common scale (additional common scale [ΔScale]).

In other words, the adding common scale (delta scale) [ΔScale] is calculated by the following [formula 3], which includes a division by the number of bands (the number of coding bands), $$\Delta\text{Scale} = \frac{\dfrac{\text{the number of actual quantization bits} - \text{the number of usable bits}}{\alpha}}{\text{the number of bands}} \qquad \text{[formula 3]}$$

where α is set to a constant value (fixed value), and for example, is set as follows in accordance with operational mode.

sampling frequency: 48 kHz, the number of channels: two⇒α=0.25 sampling frequency: 48 kHz, the number of channels: one⇒α=0.27

Regarding the value of a, for example, the optimal value thereof may be obtained from much experimental data in advance, and the optimal value may be set as the α. Alternatively, the value of a may be set without classifying for every operational mode.

In the process of step ST7, updated common scale CS is calculated by adding the adding common scale (delta scale: [ΔScale]) to the common scale [Common Scale]. In other words, the common scale CS is calculated by CS=Common Scale+ΔScale.

Specifically, it is assumed that, in the [formula 3] mentioned above, a case in which the number of bands (the number of coding bands [band]) is ten as illustrated in FIG. 2A and FIG. 2C mentioned above, and a case in which the number of bands is six as illustrated in FIG. 2B and FIG. 2D.

Comparing the case in which the number of bands is ten and the case of six in the [formula 3], since α is a fixed value, ΔScale (the amount of delta scale) when the number of bands is larger such as the denominator is 10 is smaller than that when the number of bands is smaller such as the denominator is 6.

Therefore, according to the present embodiment, it is possible to reduce the number of loops until the process is completed, by repeating the loop with common scale CS updated by the delta scale [ΔScale] obtained by the [formula 3] (the common scale [CommonScale] which is shifted by ΔScale).

In other words, as illustrated in FIG. 12, in the audio signal coding device of the present embodiment, the slope (quantization bit reduction characteristic) α is set as a constant value, and the delta scales [ΔScale] is estimated in consideration of the number of coding bands. This allows an improvement of accuracy of the bit control loop, and allows a completion of the loop processes in the smaller number of times.

Figure 13:
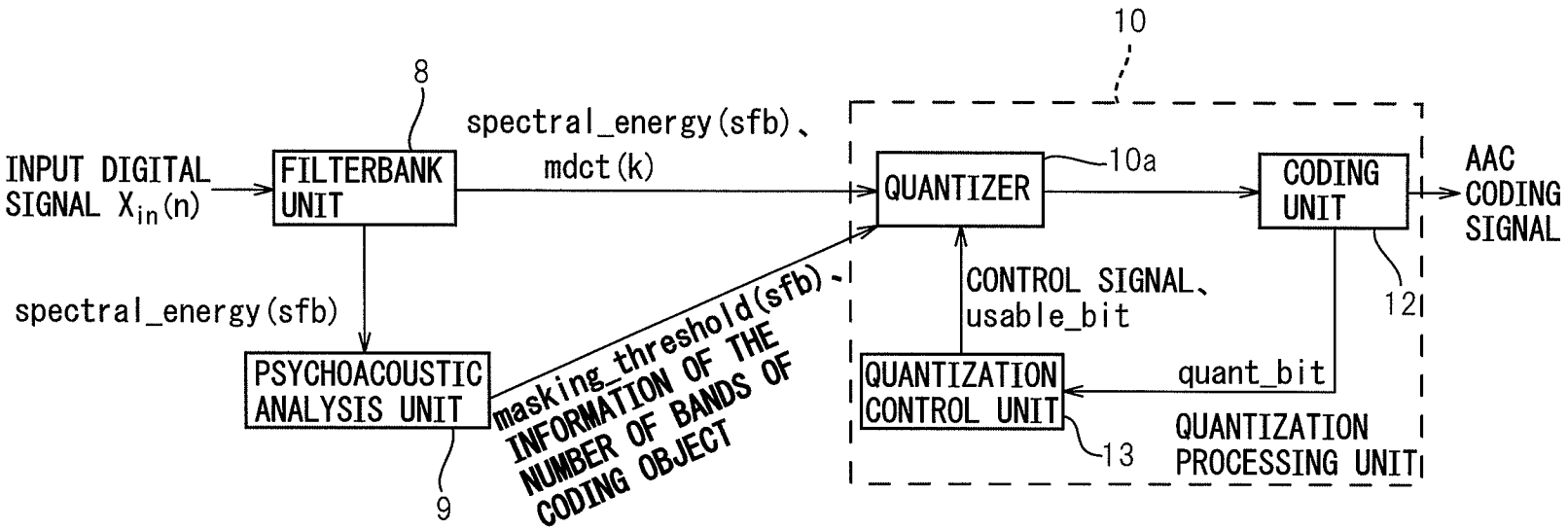
FIG. 13 is a block diagram illustrating an encoder in a first example of the audio signal coding device.
Figure 14:
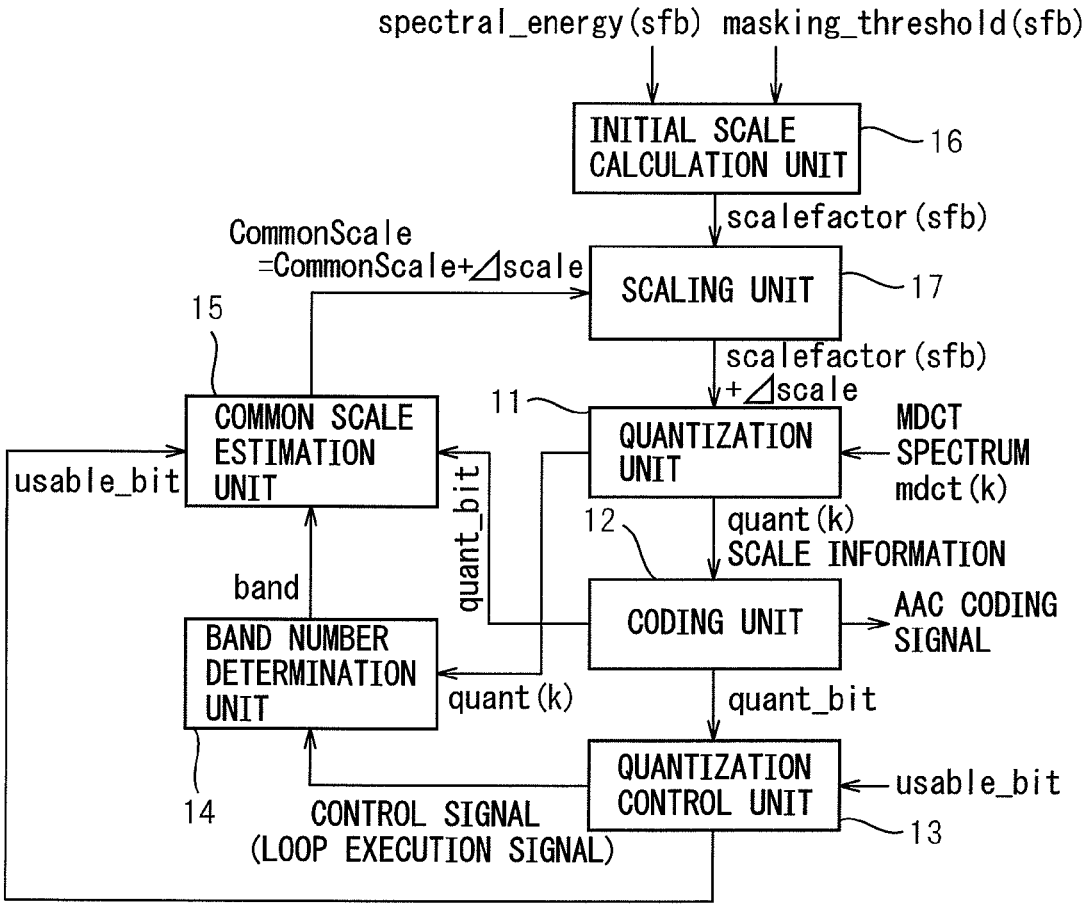
FIG. 14 is a block diagram illustrating an example of the quantization processing unit in the audio signal coding device illustrated in FIG. 13.

FIG. 13 is a block diagram illustrating an encoder in a first example of the audio signal coding device, and FIG. 14 is a block diagram illustrating an example of the quantization processing unit in the audio signal coding device illustrated in FIG. 13. FIG. 15 is a drawing for describing variables and contents of the variables, used by the quantization processing unit illustrated in FIG. 14.

In FIG. 13 and FIG. 14, a referential mark 8 illustrates a filterbank unit, 9 illustrates a psychoacoustic analysis unit, 10 illustrates a quantization processing unit, 10*a* illustrates a quantizer, and 11 illustrates a quantization unit. Moreover, a referential mark 12 illustrates a quantization control unit, 13 illustrates a quantization control unit, 14 illustrates a band number determination unit, 15 illustrates a common scale estimation unit, 16 illustrates an initial scale calculation unit, and 17 illustrates a scaling unit.

The quantizer 10*a* in FIG. 13 includes the quantization unit 11, the band number determination unit 14, the common scale estimation unit 15, the initial scale calculation unit 16, and the scaling unit 17, which are illustrated in FIG. 14.

FIG. 15 is a drawing for describing variables (parameters: signals) and contents of the variables, used by the quantization processing unit illustrated in FIG. 14. As illustrated in FIG. 15, variables used in the first example includes input digital signal [xin( )], scalefactor (52 group in total) [scalefactor( )], MDCT spectrum (1024 spectra in total) [mdct( )], and spectrum electric power of scalefactor band [spectralenergy( )].

The variables used in the first example also includes masking threshold (52 groups in total) [masking threshold( )], quantization value [quant( )], common scale [commonscale, CS], the number of coding bands [band], and delta scale [Δscale], and the number of usable bits for quantization [usable bit, UB].

The variables used in the first example further includes the number of quantization bits [quant bit, the number of quantization bits QB], subband number (0-51) [sfb], frequency index (0-1023) [k], sample number [n], and quantization bit reduction characteristic (slope) [α].

The variables xin( ), mdct( ), spectral energy( ), masking threshold( ), usable bit, quant bit, sfb, k, and n are also used in an encoder for performing the quantization process described above with reference to FIG. 3 and FIG. 4, for example.

In contrast, the variables scalefactor( ), quant( ), common scale, band, Δscale, and α are not used in the encoder for performing the quantization process illustrated in FIG. 3 and FIG. 4, but are used in the encoder in the audio signal coding device of the first example.

Figure 16:
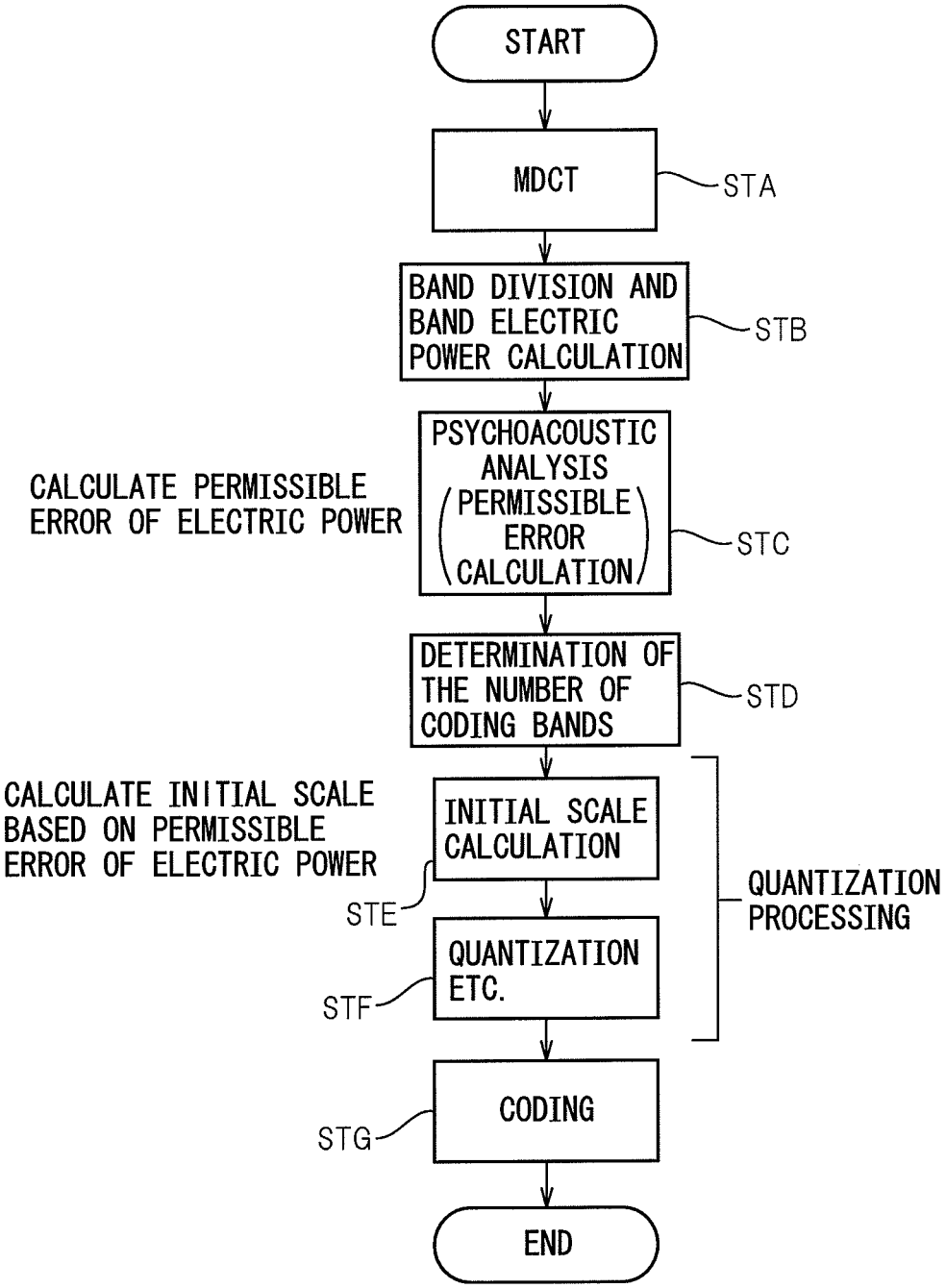
FIG. 16 is a flowchart for describing an example of an overall process of the encoder.
Figure 17:
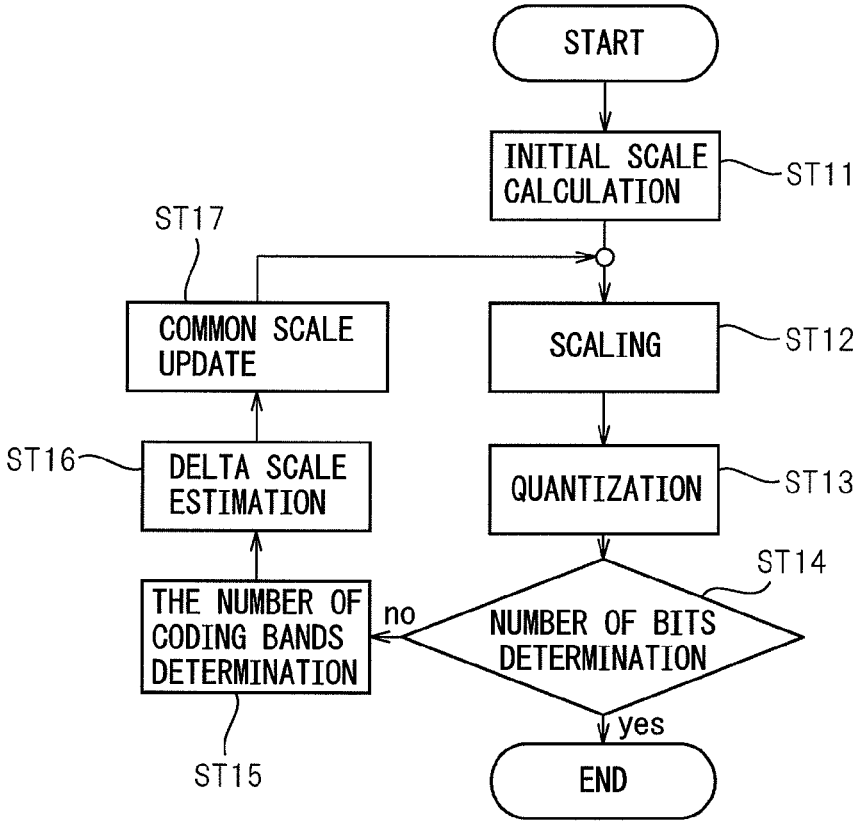
FIG. 17 is a flowchart for describing an example of the quantization process in the process illustrated in FIG. 16.

FIG. 16 is a flowchart for describing an example of an overall process of the encoder (AAC encoder), and FIG. 17 is a flowchart for describing an example of the quantization process in the process illustrated in FIG. 16. FIG. 17 is similar to FIG. 11 mentioned above, and steps S11 to ST17 in FIG. 17 correspond to steps ST1 to ST7 in FIG. 11 respectively.

First, the overall process of the AAC encoder will be described with reference to FIG. 16, and after that the first example will be illustrated in detail with reference to FIG. 13 to FIG. 15 and FIG. 17. Although the following description is given based on the specification of "3GPP TS 26.403 V9.0.0 (2009-12)," the present example is not limited to this specification.

As illustrated in FIG. 16, when the AAC encoder starts the AAC coding process, the input audio (voice) signal is time-frequency converted using modified discrete cosine transform (MDCT) in step STA. This obtains the frequency spectrum of the input audio signal (input digital signal).

<I>. In step STA, a conversion is applied in accordance with the following [formula 4] for example, to obtain a total of 1024 MDCT spectra (frequency spectra) [mdct(k)].

$$mdct(k) = 2 \cdot \sum_{n=0}^{N-1} x_{in} \cos\left(\frac{2\pi}{N}(n+n_0)\left(k+\frac{1}{2}\right)\right) \quad \text{[formula 4]}$$

N denotes a window of 2048 or 256 for MDCT conversion, and $n_0$ is (N/2+1)/2. The frequency index [k] satisfies a condition of 0≤k<n/2 where n is the sample number. Then, it proceeds to step STB to apply a band division and to calculate band electric power.

<II>. In step STB, frequency spectrum is divided into a plurality of bands, and frequency spectrum electric power of each band [spectral energy (sfb)] is calculated by the following [formula 5]. Then, it proceeds to step STC.

$$\text{spectral_energy}(sfb) = \sum_{k=sfboffset}^{sfboffsett(x)+1} \sqrt{|mdct(k)|} \quad \text{[formula 5]}$$

Note that the processes <I> and <II> mentioned above are performed by the filterbank unit 8 of FIG. 13. The filterbank unit 8 receives the input digital signal (input audio signal) [xin(n)] and performs these processes. The filterbank unit 8 outputs obtained MDCT spectra mdct (k) and the spectrum electric power [spectral energy (sfb)] of the scalefactor band to the quantization processing unit 10 (quantizer 10*a*), and outputs the [spectral energy (sfb)] to the psychoacoustic analysis unit 9.

<III>. In step STC, the psychoacoustic analysis is applied to the input audio signal to obtain the masking threshold [masking threshold (sfb)], and then it proceeds to step STD.

The masking threshold is calculated by, for example, calculating the masking thresholds for respective input audio signals and selecting a smaller one or a larger one among the masking thresholds of respective input audio signals. The power of the minimal audible field in respective frequency bands and the like may be used for the masking thresholds of respective input audio signals in a simple case. However, it is needless to say that other various known techniques may be applied as the calculation of the masking threshold.

<IV>. In step STD, the masking threshold and spectrum electric power are compared for each band, and the number of bands for quantization (the number of coding bands) is decided. In other words, the number of bands for quantization is obtained as the number of bands which satisfies a condition of masking threshold (sfb)<spectral energy (sfb).

The processes <III> and <IV> mentioned above are performed by the psychoacoustic analysis unit 9 of FIG. 13. The psychoacoustic analysis unit 9 receives the spectrum electric power of the scalefactor band [spectral energy (sfb)] from the filterbank unit 8 mentioned above, and performs these processes. Then, the psychoacoustic analysis unit 9 outputs the masking threshold [masking threshold (sfb)] and information on the number of bands for quantization to the quantization processing unit 10 (quantizer 10*a*).

Further, after performing steps STE and STF (quantization process), it proceeds to step STG to perform the coding process.

The quantization process in steps STE and STF is illustrated in detail in FIG. 17 (FIG. 11). Moreover, in step STG, it receives the coding signal (for example, AAC coding signal) applied the quantization process, and outputs a stream signal (for example, AAC bit stream signal).

Next, with reference to FIG. 13 through FIG. 15 and FIG. 17, the quantization processing unit 10 and the quantization process in the first example will be described in detail. As mentioned above, the quantizer 10*a* of FIG. 13 corresponds to the quantization unit 11, the band number determination unit 14, the common scale estimation unit 15, the initial scale calculation unit 16, and the scaling unit 17, which are illustrated in FIG. 14.

As illustrated in FIG. 17, when the quantization process (AAC coding process) in the first example is started, the initial scale is calculated in step ST11.

<V>. In step ST11, the initial value of scale [scalefactor (sfb)] is calculated by the following [formula 6] for the bands for quantization, and it proceeds to step ST2.

$$scalefactor(sfb) = -2.0 \times \left( \log_2 \frac{\text{masking_threshold}(sfb)}{dw(sfb)} + \frac{8}{3} \right) \quad \text{[formula 6]}$$

dw represents the number of MDCT coefficients included in the subband (sfb). The process <v> mentioned above is performed by the initial scale calculation unit 16 of FIG. 14. The initial scale calculation unit 16 receives the spectrum electric power of the scalefactor band [spectral energy (sfb)] from the filterbank unit 8 mentioned above and the masking threshold [masking threshold (sfb)] from the psychoacoustic analysis unit 9, and performs the process. Then, the initial scale calculation unit 16 outputs the obtained initial value of scale [scalefactor (sfb)] to the scaling unit 17.

<VI>. The scaling is performed in step ST12, and it proceeds to step ST13 to perform the quantization. In other words, the quantization value [quant (k)] is obtained by the following [formula 7] in step ST12, and it proceeds to step ST14.

$$\text{quant}(k)=\text{int}[|\text{mdct}(k)|^{3/4} \times 2^{3/16 \times (scalefactor(sfb)-CommanScale)} + \text{MAGIC_NUMBER}] \quad \text{[formula 7]}$$

In a first step, the common scale is set as commonscale=0, and for example, MAGIC NUMBER is set as MAGIC NUMBER=0.4054. MAGIC NUMBER=0.4054 is a constant value specified in the specification of "3GPP TS 26.403 V9.0.0 (2009-12)" mentioned above. The process <VI> (processes of steps ST12 and ST13) is performed by the scaling unit 17 and the quantization unit 11, which are illustrated in FIG. 14.

In other words, the scaling unit 17 receives the initial value of the scale [scalefactor (sfb)] from the initial scale calculation unit 16 mentioned above and the common scale [CommonScale+Δscale] processed by the common scale estimation unit 15 mentioned below, and performs the process. The scaling unit 17 outputs the result of scalefactor(sfb)+Δscale to the quantization unit 11.

The quantization unit 11 receives the MDCT spectrum [mdct (k)] from the filterbank unit 8 mentioned above and the result of scalefactor(sfb)+Δscale from the scaling unit 17, and performs the process. The quantization unit 11 outputs the obtained quantization value [quant (k)] to the band number determination unit 14, as well as outputs quant (k) and scale information to the coding unit 12.

Note that the processes of steps ST11 to ST13 mentioned above (process of steps ST1 to ST3 in FIG. 11) correspond to the processes of steps ST101 to ST103 in FIG. 4 mentioned above and the processes of steps ST201 to ST203 in FIG. 7.

<VII>. In step ST14, the number of quantization bits are determined (a determination for loop finishing in which it is determined whether or not the number of quantization (initial) bit [quant bit] is equal to or less than the number of usable bits for quantization (usable bit: UB)). In other words, in step ST14, the determination in accordance with the following [conditional expression 1] is performed. When it is determined that the number of quantization bits [quant bit] is not equal to or less than the number of usable bits for quantization [usable bit] (quant bit>usable bit), it proceeds to step ST15.

```
if quant_bit > usable_bit
        to processes VIII through X
else
        finish quantization loop, multiplex
without any change to generate stream (end)
                                [conditional expression 1]
```

When it is determined that [quant bit] is equal to or less than [usable bit] (quant bit usable bit) in step ST14, the quantization process (quantization loop) is finished and a coded signal (AAC coded signal) is output. The AAC coded signal output from this quantization processing unit 10 (AAC encoder) is output as the AAC stream signal through the stream output unit 56 of FIG. 29, for example.

The process <VII> mentioned above is performed by the coding unit 12 and the quantization control unit 13, which are illustrated in FIG. 14. The coding unit 12 receives the quantization value [quant (k)] and the scale information from the quantization unit 11, and performs the process. The coding unit 12 outputs the number of quantization bits [quant bit] to the quantization control unit 13 and the common scale estimation unit 15.

The quantization control unit 13 receives the number of quantization bits [quant bit] and the number of usable bits for quantization [usable bit] from the coding unit 12, and performs the process. The quantization control unit 13 outputs a control signal (loop execution signal) to the band number determination unit 14. The number of usable bits for quantization [usable bit] input into the quantization control unit 13 is also output to the common scale estimation unit 15 mentioned below.

<VIII>. In step ST15, the number of coding bands is determined, and then it proceeds to step ST16. In other words, in step ST15, the determination in accordance with the following [conditional expression 2] is performed to calculate the number of coding bands [band].

```
for (k=0 k<1024 k++) {
    if quant(k) ≠ 0
        band++
}                               [conditional expression 2]
```

The process <VIII> mentioned above is performed by the band number determination unit 14 illustrated in FIG. 14. The band number determination unit 14 receives the quantization value [quant (k)] from the quantization unit 11 and the control signal from the quantization control unit 13, and performs the process. The band number determination unit 14 outputs the number of coding bands [band] to the common scale estimation unit 15.

In other words, the band number determination unit 14 counts the number of bands in which the quantization value is not "0" among overall bands. Since the MDCT coefficients are coded using the quantization value [quant (k)] and (scale [scalefactor(sfb)]−common scale [commonscale]), the part (band) in which the quantization value is not "0" (quant(k)≠0: quant(k)≠0) is the object of coding.

<IX>. The delta scale is estimated in step ST16, and it proceeds to step ST17. In other words, in step ST16, the delta scale [Δscale] is calculated by the following [formula 8], and it proceeds to step ST17.

$$\Delta\text{scale} = \frac{\text{quant_bit} - \text{usable_bit}}{\text{band} \times \alpha} \quad \text{[formula 8]}$$

<X>. In step ST17, the common scale is updated, and it returns to step ST12 to repeat processes (processes <VI> to <X> in the same manner. In other words, in step ST17, the updated common scale [CommonScale, CS] is calculated by the following [formula 9], and it returns to step ST12.

$$\text{CommonScale}=\text{CommonScale}+\Delta\text{scale} \quad \text{[formula 9]}$$

The process <IX> and <X> are performed by the common scale estimation unit 15 illustrated in FIG. 14. The common scale estimation unit 15 receives the number of quantization bits [quant bit] from the coding unit 12, the number of coding bands [band] from the band number determination unit 14, and the number of usable bits for quantization [usable bit], and performs the update process of common scale [CommonScale]. Then, the common scale estimation unit 15 outputs the updated common scale [CommonScale](=CommonScale+Δscale) to the scaling unit 17.

The audio signal coding method (quantization processing method) described above may be implemented as a hardware circuit, or implemented as a software program executed by an arithmetic processing unit (CPU 54: computer) of FIG. 29 mentioned below, for example.

The program to be executed by the CPU 54 (computer) is stored, for example, in a memory (nonvolatile memory 540) provided in the CPU 54. Moreover, this program has been recorded, for example, on a hard disk drive 61 located on a program (data) provider 60 and a portable recording medium (memory card) 70, and is loaded into the nonvolatile memory 540 through an I/O unit 57, for example.

As mentioned above, in the first example, the band number determination unit 14 performs the determination process of the number of coding bands (process <VIII>: process of step ST15). Furthermore, the common scale estimation unit 15 performs the estimation process of delta scale (process <IX>: process of step ST16) and the update process of common scale (process <X>: process of step ST17).

The concrete processes performed by the band number determination unit 14 and the common scale estimation unit 15 are as having described in detail with reference to FIG. 10 through FIG. 12, [formula 3] and so on, for example. In other words, in the first example, Δscale is calculated by a formula, Δscale=[(quant bit)−(usable bit)]/[α×(band)].

Then, using the obtained Δscale, the common scale is obtained by CommonScale (estimated common scale CS)=CommonScale+ΔScale. With respect to the value of α, an optimal value is obtained in advance from a large quantity of experimental data items, and the value may be stored, for example, in the nonvolatile memory 540 provided in the CPU 54 in FIG. 29.

As having described above in detail, according to the first example, it is possible to reduce the number of loops (bit control loops) until the number of quantization bits [quant bit] is equal to or less than the number of usable bits for quantization [usable bit], and it is possible to shorten the time for the quantization process.

Figure 18:
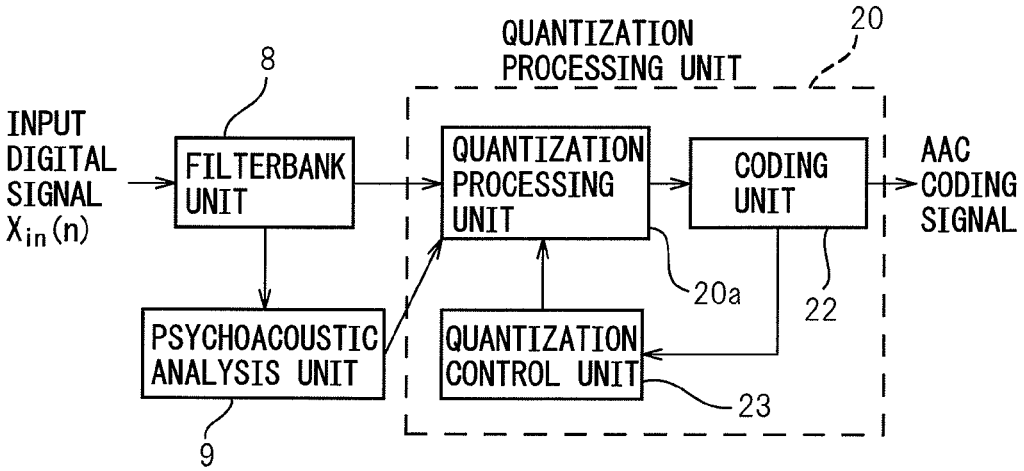
FIG. 18 is a block diagram illustrating an encoder in a second example of the audio signal coding device.
Figure 19:
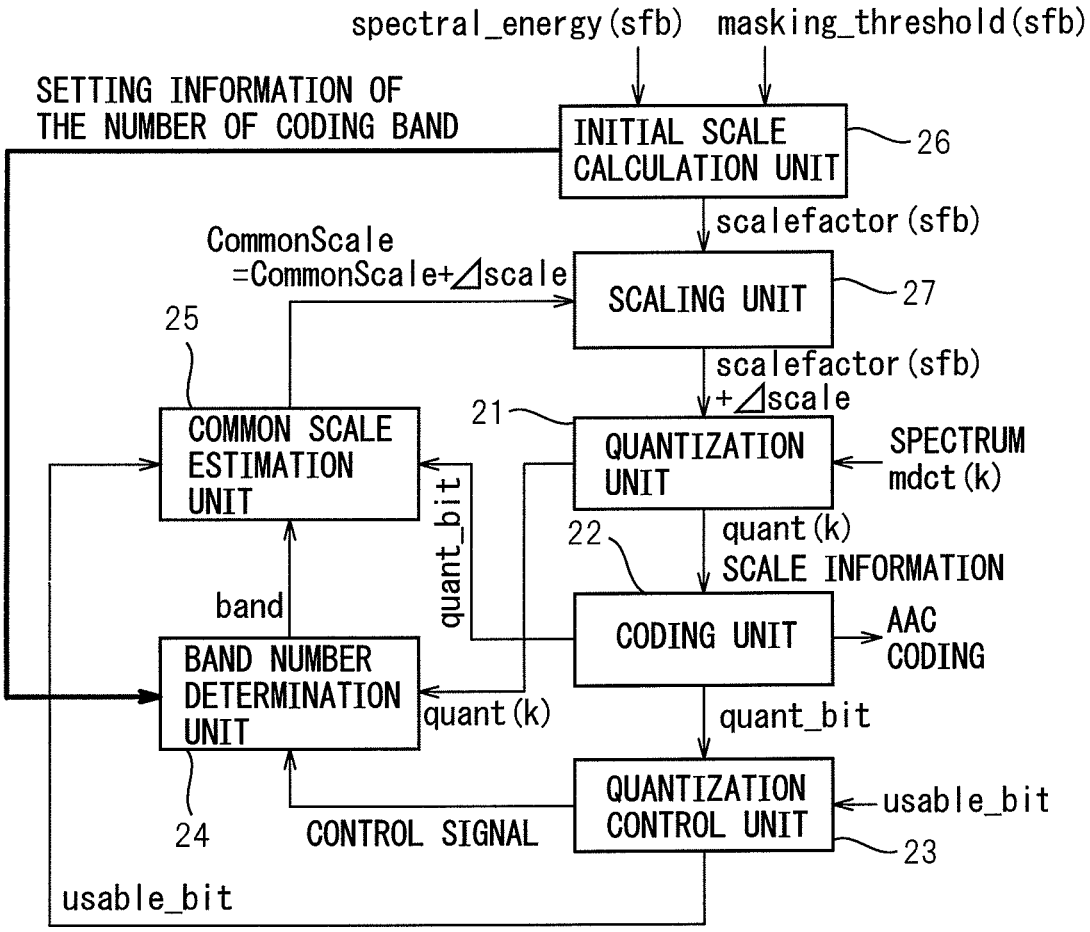
FIG. 19 is a block diagram illustrating an example of a quantization processing unit in the audio signal coding device illustrated in FIG. 18.

FIG. 18 is a block diagram illustrating an encoder in a second example of the audio signal coding device, and FIG. 19 is a block diagram illustrating an example of a quantization processing unit in the audio signal coding device illustrated in FIG. 18. FIG. 20 is a drawing for describing variables and the contents of the variables, used by the quantization processing unit illustrated in FIG. 19.

Figure 21A:
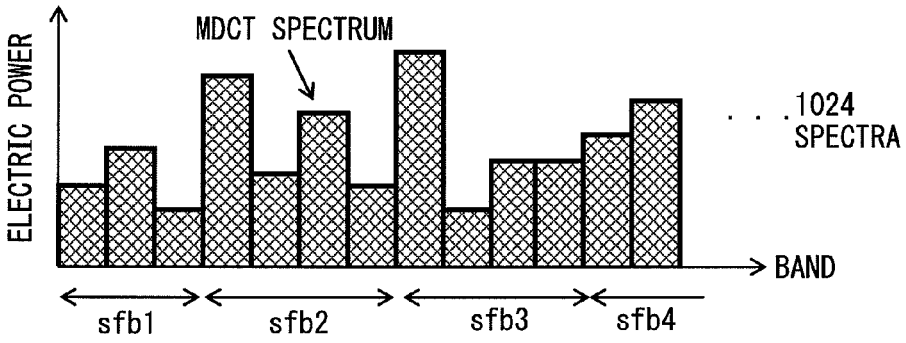
FIG. 21A, FIG. 21B, and FIG. 21C are drawings for describing a scalefactor band.
Figure 21B:
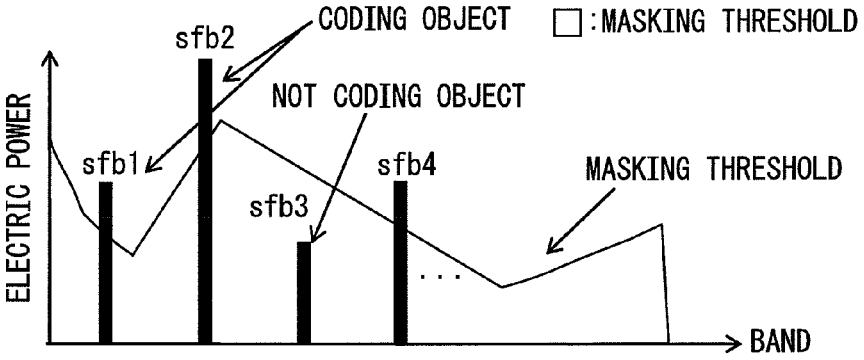
Figure 21C:
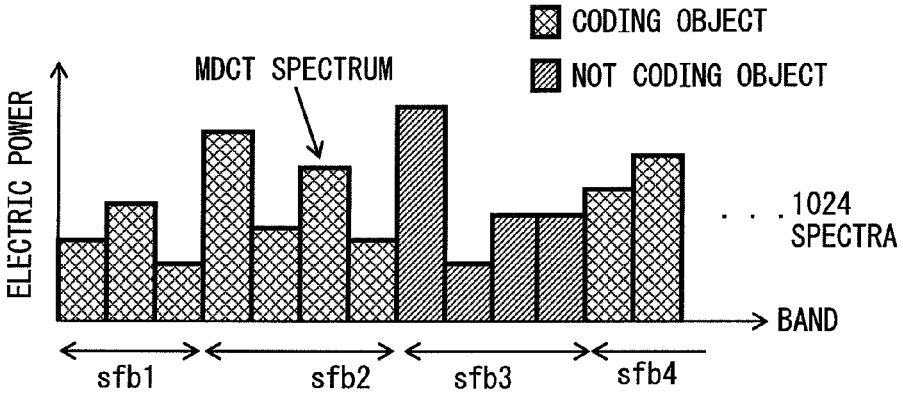
Figure 22:
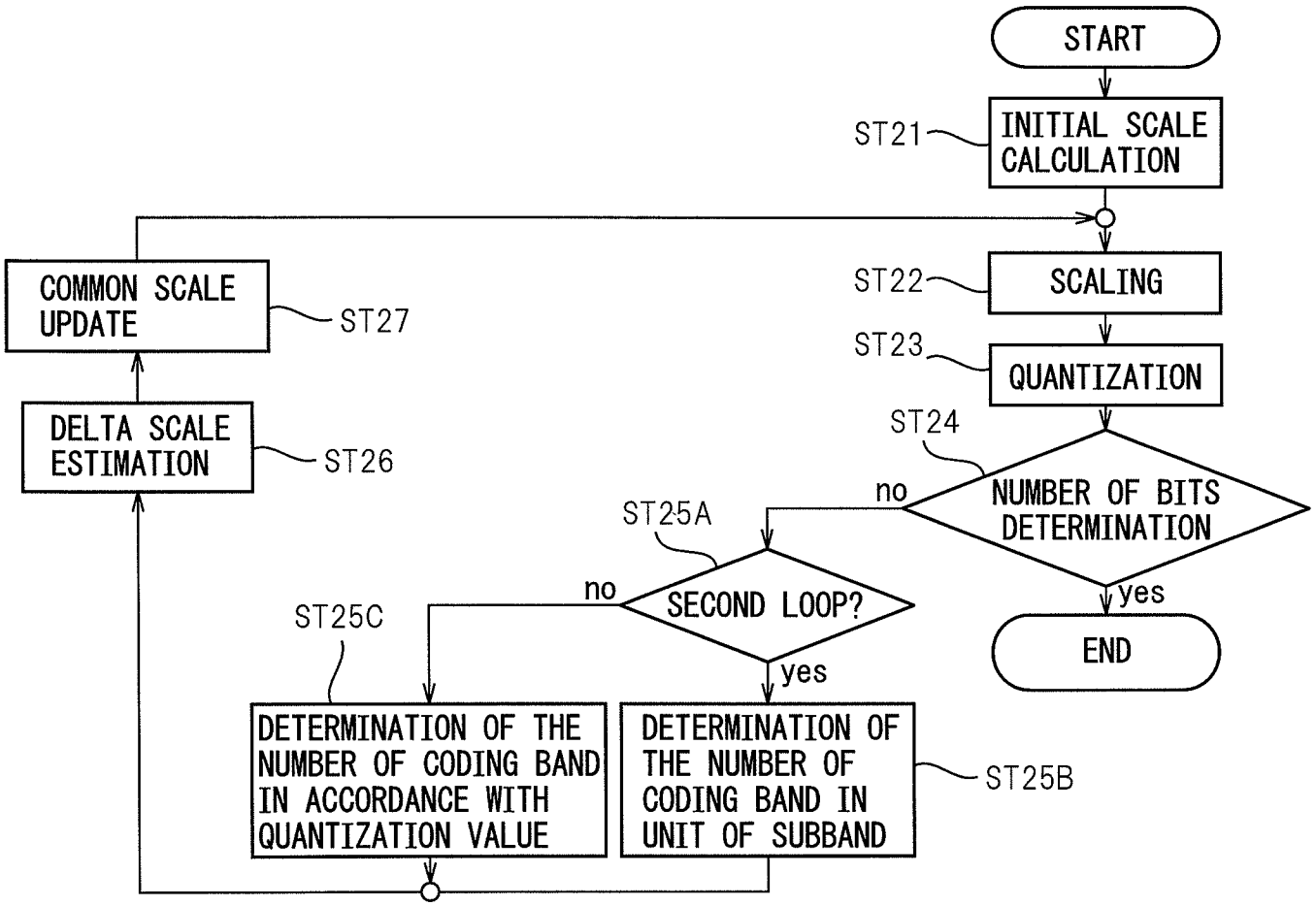
FIG. 22 is a flowchart for describing an example of the process executed by the quantization processing unit illustrated in FIG. 20.

Furthermore, FIG. 21A, FIG. 21B, and FIG. 21C are drawings for describing a scalefactor band, and FIG. 22 is a flowchart for describing an example of the process executed by the quantization processing unit illustrated in FIG. 20.

FIG. 21A illustrates a relation between 1024 MDCT spectra [mdct (k)] and subbands [sfb] with 52 groups at a maximum, and FIG. 21B illustrates a situation in which the subband [sfb3] is masked by the masking threshold. FIG. 21C illustrates an aspect in which the number of subbands [sfb] is decreased by 1, due to the mask of sfb3 as illustrated in FIG. 21B.

In each of FIG. 21A to FIG. 21C, a vertical axis represents electric power and a horizontal axis illustrates a band (the number of bands).

In the first example mentioned above, as illustrated in the process <VIII> (process of step ST15) and the [conditional expression 2], the number of coding bands [band] is obtained in each loop from the bands in which the quantization value [quant(k)]≠0.

On the other hand, in the second example, as is clear from a comparison between FIG. 22 and FIG. 17, the steps ST25A to ST25C are performed as a process of determining the number of coding bands (step ST15 in FIG. 17).

In other words, according to the second example, in the second loop, the determination of the number of coding bands is performed in the unit of group of subbands (sfb), but is not performed for each MDCT spectrum [mdct (k)].

Note that FIG. 18 to FIG. 20 for the second example correspond to FIG. 13 to FIG. 15 for the first example mentioned above, except for a fact that a control signal for setting the number of coding bands is output from the initial scale calculation unit 26 to the band number determination unit 24 in FIG. 19.

The quantizer 20*a*, the coding unit 22, and the quantization control unit 23 of the quantization processing unit 20 in FIG. 18 correspond to the quantizer 10*a*, the coding unit 12 and the quantization control unit 13 of the quantization processing unit 10 in FIG. 13 respectively, which are mentioned above.

Moreover, the common scale estimation unit 25 and the scaling unit 27 in FIG. 19 correspond to the common scale estimation unit 15 and the scaling unit 17 in FIG. 14. The variables and those contents illustrated in FIG. 20 are similar to those in FIG. 15 mentioned above.

Steps ST21 to ST24, ST26 and ST27 in FIG. 22 correspond to steps ST11 to ST14, ST16 and ST17 in FIG. 17 respectively, which are mentioned above. Therefore, description for those units and steps will be omitted in the second example, and difference parts with the first example are mainly described in detail.

As mentioned above, according to the second example, in the second loop, the determination of the number of coding bands is performed in the unit of group of subbands (sfb), but is not performed for each MDCT spectrum [mdct (k)].

In other words, when it is determined that the number of quantization bits [quant bit] is not equal to or less than the number of usable bits for quantization [usable bit] (quant bit>usable bit) in step ST24 of FIG. 22, it proceeds to step ST25A and determines whether or not this loop is the second loop.

When it is determined that this loop is the second loop in step ST25A, it proceeds to step ST25B to determine the number of coding bands in the unit of subband. Then, it proceeds to step ST26 to estimate delta scale.

When it is determined on the other hand that this loop is not the second loop in step ST25A, it proceeds to step ST25C to determine the number of coding bands in accordance with the quantization value, as is the case in the first example mentioned above. Then, it proceeds to step ST26 to estimate delta scale.

Therefore, in the second example, following process <VIIIa> is performed instead of the process <VIII> in the first example mentioned above. Note that, since other processes <I> to <VII>, <IX> and <X> in the first example are similar in the second example, the description for the processes is omitted.

<VIIIa>. In steps ST25A through ST25C, it performs a determination in accordance with the following [conditional expression 3] and the number of coding bands [band] is calculated.

```
if this loop is second quantization loop
    for (sfb = 0 sfb<52 sfb++) {
        if object scalefactor band is coding object
            band = band + the number of MDCT in
scalefactor band
    }
else
    for (k=0 k<1024 k++) {
        if quant (k) ≠ 0
            band++
}
```

[conditional expression 3]

The above-described process <VIIIa> is performed by the band number determination unit 24 illustrated in FIG. 19. The band number determination unit 24 receives the quantization value [quant (k)] from the quantization unit 21 and the control signal from the quantization control unit 23, and performs the process. The band number determination unit 24 outputs the number of coding bands [band] to the common scale estimation unit 25. The setting information of the number of coding bands from the initial scale calculation unit 26 is input into the band number determination unit 24.

In other words, the band number determination unit 24 may recognize whether or not this loop is the second loop by the setting information of the number of coding bands from the initial scale calculation unit 26. When this loop is the second loop, the determination of the number of coding bands is performed in the unit of group of subbands (sfb), but is not performed for each MDCT spectrum [mdct (k)].

As mentioned above with reference to FIG. 21A through FIG. 21C, MDCT spectra [mdct (k)] have 1024 spectra, for example, whereas the groups of the subbands [sfb] have 52 groups at a maximum, and therefore, determining the number of coding bands according to sfb allows a reduction of throughput.

In the second example, when the loop is the third loop, as is the case in the first example mentioned above, for overall bands (1024 MDCT spectra [mdct (k)]), the part (band) in which the quantization value is not "0" (quant(k)≠0) is counted as the object of coding.

This is because, first, when the scale increases, the quantization value [quant (k)] approaches 0, and the number of coding bands decreases. Moreover, this is also because, the determination of the coding object according to the scalefactor band is one time before the quantization, and therefore the larger the scale is (the more the number of times of the quantization loop takes), the larger the error of the number of coding bands is.

As mentioned above, according to the second example, although an estimation accuracy may be slightly reduced by determining the number of coding bands in the unit of group of the subbands [sfb] at the second loop, it is possible to reduce the throughput and to shorten the time for the quantization process.

Figure 23:
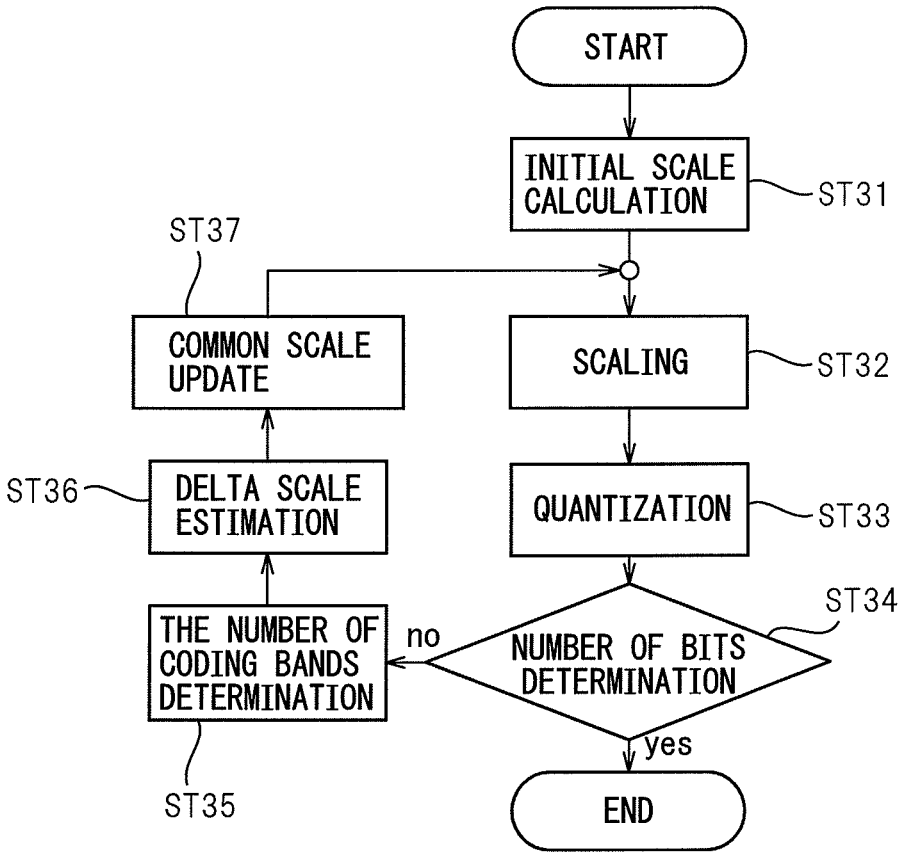
FIG. 23 is a flowchart for describing an example of a process executed by a quantization processing unit of an encoder in a third example of the audio signal coding device.

FIG. 23 is a flowchart for describing an example of a process executed by a quantization processing unit of an encoder in a third example of the audio signal coding device. As is clear from a comparison between FIG. 23 and FIG. 17 mentioned above, the quantization process in the third example substantially corresponds to the quantization process of the first example.

Although steps ST31 through ST37 in the third example in FIG. 23 are illustrated similar to steps ST11 through ST17 in the first example in FIG. 17, the determination process of the number of coding bands of step ST35 in the third example is different from that in the first example. In other words, in the third example, the band where the coding amount (spe bit (k)) no longer decrease to determine the number of coding bands is considered as a band not to be coded.

Figure 24A:
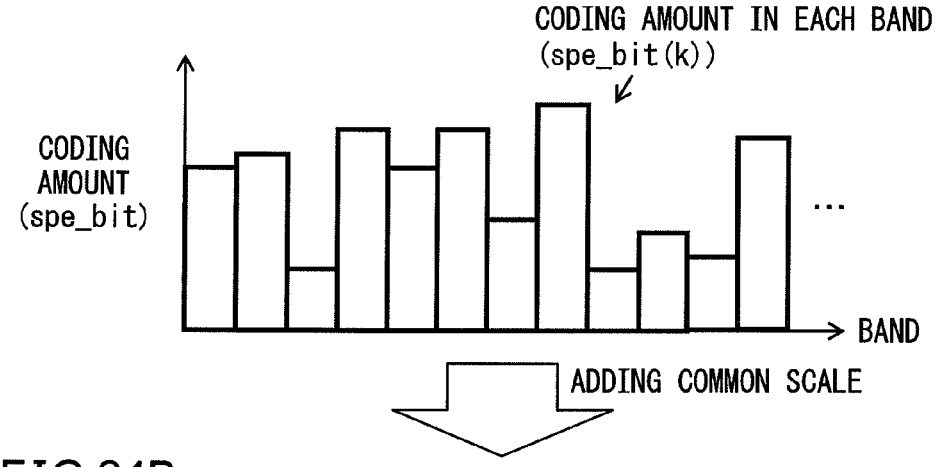
FIG. 24A and FIG. 24B are drawings for describing changes of coding amounts in respective bands when a common scale is added, in the third example of the audio signal coding device.
Figure 24B:
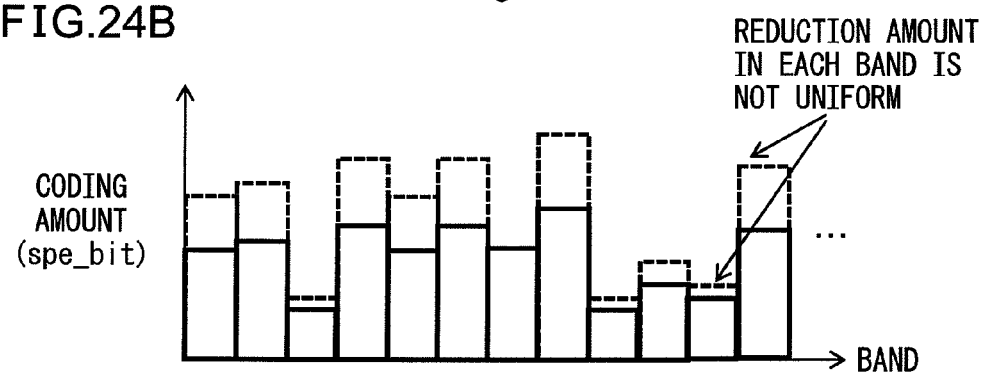
Figure 25:
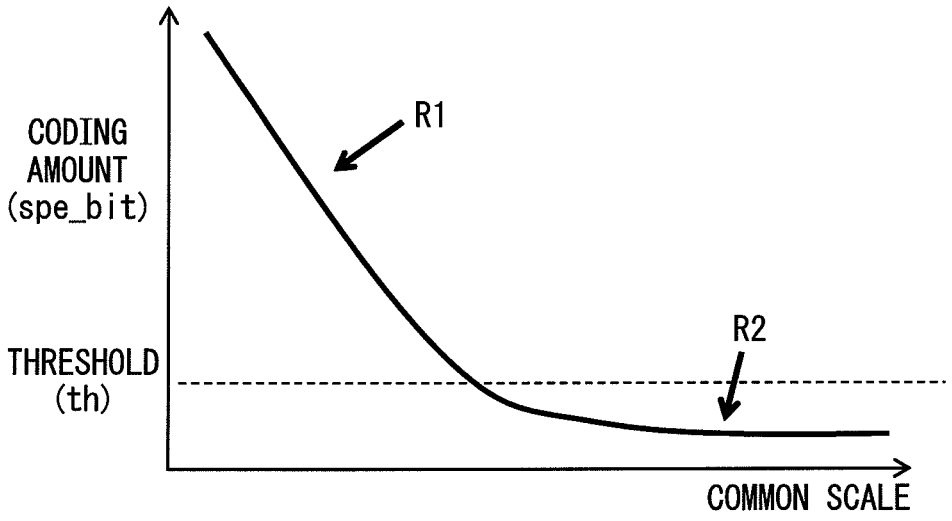
FIG. 25 is a drawing for describing a relation between a threshold of the coding amount, and the common scale in the third example of the audio signal coding device.
Figure 26:
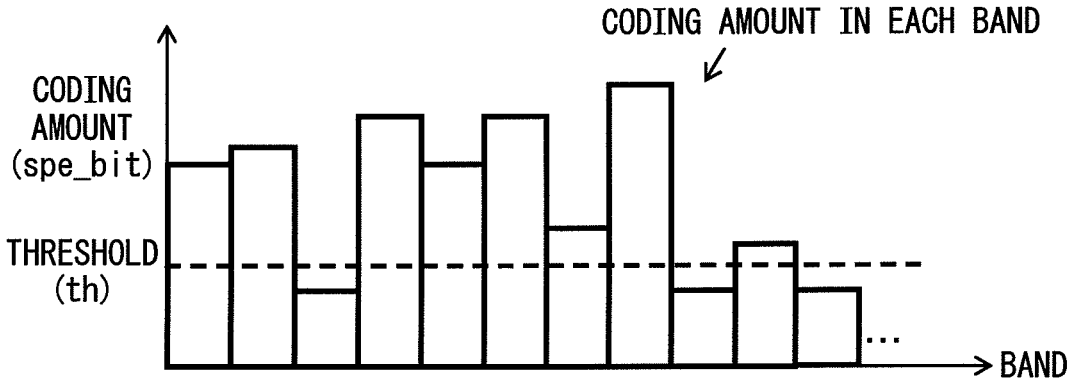
FIG. 26 is a drawing for describing a relation between a threshold of the coding amount, and the coding amounts in respective bands in the third example of the audio signal coding device.

FIG. 24A and FIG. 24B are drawings for describing changes of coding amounts in respective bands when a common scale is added, in the third example of the audio signal coding device. FIG. 25 is a drawing for describing a relation between a threshold of the coding amount and the common scale. FIG. 26 is a drawing for describing a relation between a threshold of the coding amount, and the coding amounts in respective bands in the third example of the audio signal coding device.

FIG. 24A illustrates the coding amount [spe bit (k)] in each band before adding the common scale [common scale, CS], and FIG. 24B illustrates the coding amount [spe bit (k)] in each band after adding the common scale [common scale].

As is clear from a comparison between FIG. 24A and FIG. 24B, it is found that even if the adding common scale [common scale] increases, the reduction of the coding amount [spe bit(k)] in each band is not uniform.

Furthermore, in FIG. 25, when increasing the common scale, the coding amount [spe bit] decreases at a constant rate in an area illustrated with the referential mark R1. However, in an area illustrated with the referential mark R2, even if the common scale is increased, the coding amount [spe bit] is difficult to decrease.

Therefore, in the third example, as illustrated in FIG. 26, a certain threshold th is provided and the band is determined in which the coding amount [spe bit] does not decrease even if the common scale [common scale, CS] increases, and the number of coding bands is counted.

In other words, for each band, the band in which the coding amount [spe bit(k)] does not fall under the threshold value th is considered as the band not to be coded.

In the third example, the following process <VIIIb> is performed instead of the process <VIII> in the first example mentioned above. Note that, since other processes <I> to <VII>, <IX> and <X> in the first example are similar in the third example, the description for the processes is omitted.

<VIIIb>. In step ST35, it performs a determination in accordance with the following [conditional expression 4] and the number of coding bands [band] is calculated.

```
for (k=0 k<1024 k++) {
  if quant(k) ≠ 0 and spe_bit(k) > th
    band++
}                          [conditional expression 4]
```

The above-described process <VIIIb> is performed by a component corresponding to the band number determination unit 14 of the first example illustrated in FIG. 14 and mentioned above. The component corresponding to the band number determination unit 14 determines the part (band) in which the quantization value is not "0" (quant(k)≠0) as in the first example, and also determines the band in which the coding amount is equal to or more than a threshold (spe bit(k)>th). In other words, the component obtains the band, as the number of coding bands, in which the quantization value is not "0" (quant (k)≠0), and in which the coding amount is equal to or more than the threshold (spe bit(k)>th).

In this way, according to the third example, in addition to the first example mentioned above, excluding the band in which the coding amount is difficult to decrease even if the common scale increases (it does not fall under a certain threshold) from the number of coding bands further improve the estimation accuracy.

Figure 27:
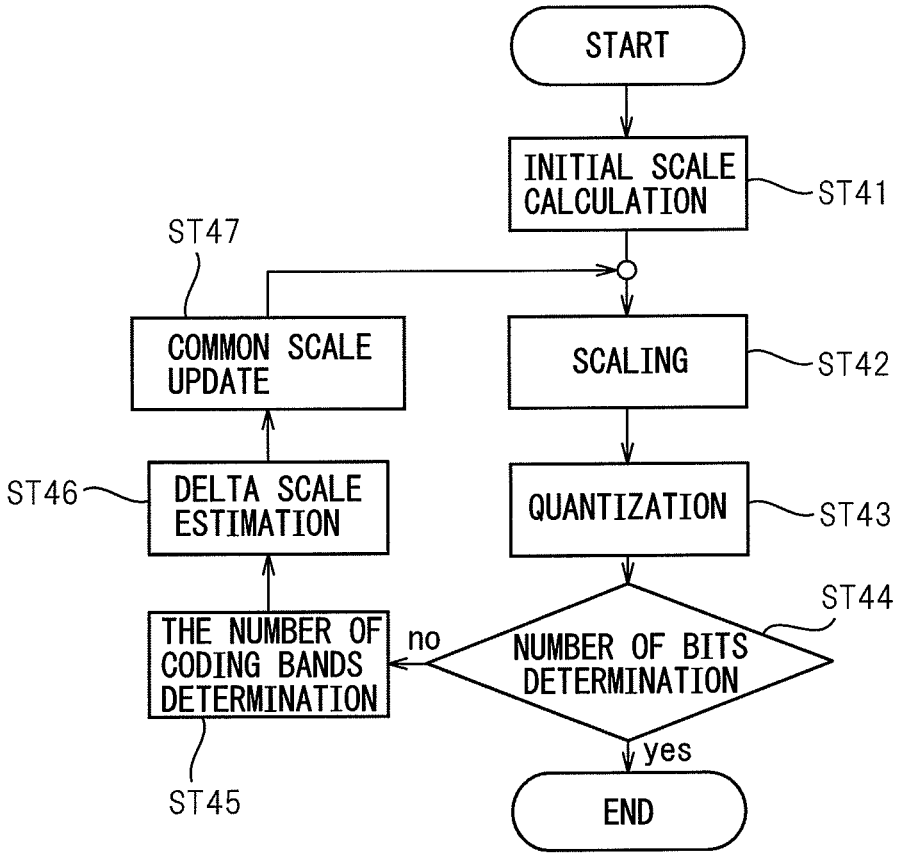
FIG. 27 is a flowchart for describing an example of the process executed by a quantization processing unit of an encoder in a fourth example of the audio signal coding device.
Figure 28A:
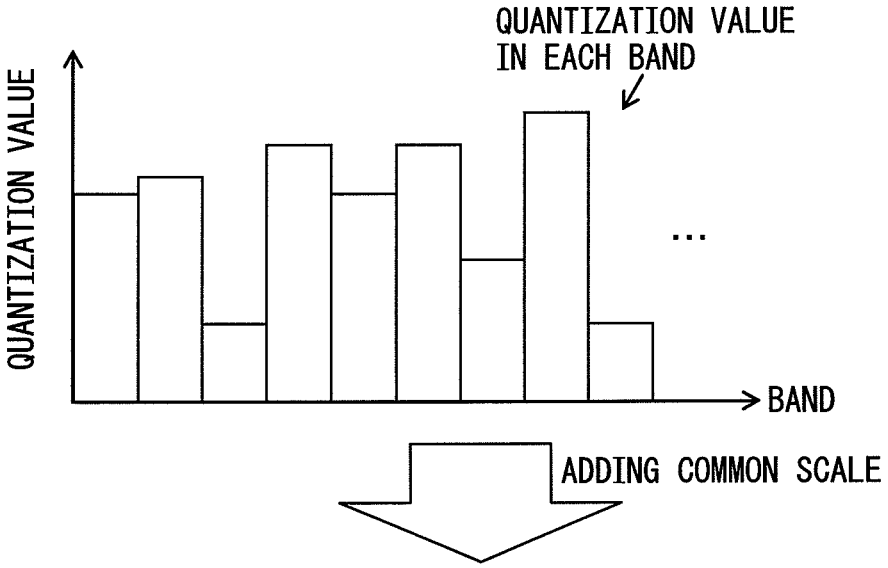
FIG. 28A and FIG. 28B are drawings for describing changes of coding amounts in respective bands when a common scale is added, in the fourth example of the audio signal coding device.
Figure 28B:
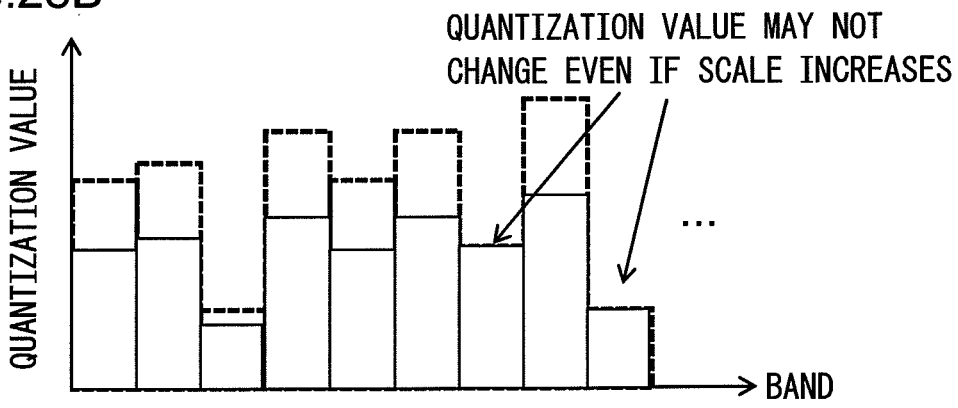

FIG. 27 is a flowchart for describing an example of the process executed by a quantization processing unit of an encoder in a fourth example of the audio signal coding device. FIG. 28A and FIG. 28B are drawings for describing changes of coding amounts in respective bands when a common scale is added, in the fourth example of the audio signal coding device.

FIG. 28A illustrates the quantization value [quant (k)] in each band before adding the common scale [common scale, CS], and FIG. 28B illustrates the quantization value [quant (k)] in each band after adding the common scale [common scale].

As is clear from a comparison between FIG. 28A and FIG. 28B, it is found that the quantization value [quant(k)] in each band may not change even if adding common scale [common scale] increases.

Hereinafter, an example of a factor of unchange is described. The quantization value [quant (k)] may be calculated from the following [formula 10]. According to the [formula 10], since the calculation result is integer type, the quantization value [quant (k)] may not change, even if the common scale [common scale] increases.

$$\text{quantization value}=\text{int}(\text{mdct coefficient}^{3/4}\times 2^{-3/16\times scale}) \quad \text{[formula 10]}$$

Specifically, according to the following [formula 11] and [formula 12], the common scales [common scale] are different such as "25" and "30", but the obtained quantization values are equal, such as 75 for both cases.

$$\text{quantization value} = \text{int}(\text{constant value } A\times 2^{-3/16\times 25}) = \text{int}(75.98) = 75 \quad \text{[formula 11]}$$

$$\text{quantization value} = \text{int}(\text{constant value } A\times 2^{-3/16\times 30}) = \text{int}(75.02) = 75 \quad \text{[formula 12]}$$

Accordingly, in the fourth example, the number of coding bands is counted with the exclusion of the band in which quantization value [quant (k)] does not change even if the common scale [common scale, CS] increases. In other words, for each band, the band in which the quantization value [quant (k)] does not change is considered as the band not to be coded, and the number of coding bands is obtained.

In the fourth example, the following process <VIIIc> is performed instead of the process <VIII> in the first example mentioned above. Note that, since other processes <I> to <VII>, <IX> and <X> in the first example are similar in the fourth example, the description for the processes is omitted.

<VIIIc>. In step ST45, it performs a determination in accordance with the following [conditional expression 5] and the number of coding bands [band] is calculated.

```
for (k=0 k<1024 k++) {
if quant(k, no) ≠ 0 and quant(k, no−1) ≠ quant(k, no)
    band++
}                          [conditional expression 5]
```

The above-described process <VIIIc> is performed by the component corresponding to the band number determination unit 14 of the first example illustrated in FIG. 14 and mentioned above. The component corresponding to the band number determination unit 14 determines the part (band) in which the quantization value is not "0" (quant(k)≠0) as in the first example, and also determines the band in which the quantization value changes (quant(k, no−1)≠quant(k, no)). In other words, the component obtains the band, as the number of coding bands, in which the quantization value is not "0" (quant(k)≠0), and in which the quantization value changes (quant(k, no−1)≠quant(k, no)). Note that "no" represents a quantization loop count.

Determination of the change of the quantization value is not limited to the determination by corresponding quantization values in the loop no and the loop no−1 which is one loop before the loop no (quant (k, no−1)≠quant (k, no)). For example, a determination based on two continuous loops may be performed in accordance with loop no, determination (quant (k, no−1)≠quant (k, no)) of the quantization value in a loop one loop before the loop no, and determination (quant (k, no−2)≠quant (k, no)) of the quantization value in a loop two loop before the loop no. The number of loops for the determination is not limited to two continuous loops, and may be still larger number of times (for example, three loops).

In this way, according to the fourth example, in addition to the first example mentioned above, excluding the band in which the quantization value does not change even if the common scale increases from the number of coding bands further improves the estimation accuracy.

Furthermore, the number of coding bands may be obtained in combination with the third example and the fourth example, which are mentioned above. In other words, as the process <VIII> in the first example, the band may be obtained as the number of coding bands, in the band the quantization value being not "0" (quant (k)≠0), the coding amount being equal to or more than a threshold (spe bit(k)>th), and the quantization value changing (quant(k, no−1)≠quant (k, no)).

Figure 29:
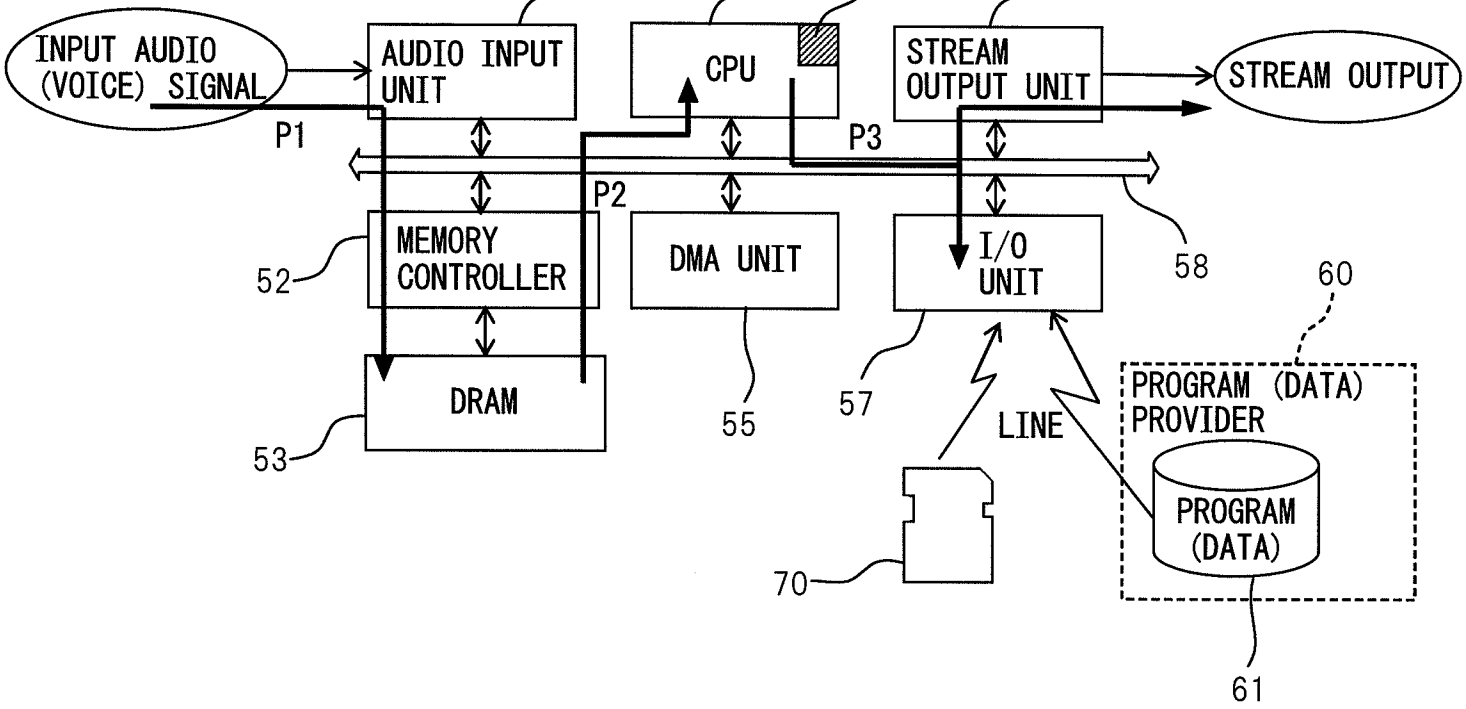
FIG. 29 is a block diagram illustrating an example of an entire constitution of the audio signal coding device.

FIG. 29 is a block diagram illustrating an example of an entire constitution of the audio signal coding device. In FIG. 29, the referential mark 51 illustrates an audio input unit, 52 illustrates a memory controller, 53 illustrates a DRAM (Dynamic Random Access Memory), 54 illustrates a CPU (Central Processing Unit), and 55 illustrates a DMA (Direct Memory Access) unit.

Moreover, the referential mark 56 illustrates a stream output unit, 57 illustrates an I/O (Input/Output Port) unit, and 58 illustrates a bus.

As illustrated in FIG. 29, the audio signal coding device includes the audio input unit 51, the memory controller 52, the DRAM 53, the CPU 54, the DMA unit 55, the stream output unit 56, the I/O unit 57, and the bus 58.

The audio input unit 51 receives the audio (voice) signal input from the outside, thus the signal is provided to a system. The input audio signal may be given as a digital signal, but when the input audio signal is an analog signal, the audio input unit 51 converts the signal into the digital signal by the analog-digital conversion with a certain sampling frequency, thus the digital signal is provided to the system. In the following description, it is assumed that the audio input signal is digital data.

The memory controller 52 controls writing (Read) and read-out (Write) to the DRAM 53 in accordance with instructions and the like from the CPU 54. The CPU 54 performs a control for overall audio signal coding device and the coding process to the input data, and outputs a stream (for example, AAC stream) through the stream output unit 56.

The CPU 54 includes, for example, a ROM (Read Only Memory) or a nonvolatile memory 540 such as a flash memory (Flash Memory) or an MRAM (Magnetoresistive Random Access Memory).

The nonvolatile memory 540 stores, for example, a memory table in which the quantization bit reduction characteristic (slope) $\alpha$ mentioned above is specified according to parameters such as the bit rate. Furthermore, the nonvolatile memory 540 stores an audio signal coding program for causing the CPU 54 (arithmetic processing unit: computer) to execute an audio signal coding process (quantization process) mentioned above.

The audio signal coding program may be stored into the nonvolatile memory 540 through the I/O unit 57 from the portable recording medium (SD (Secure Digital) memory card) 70 on which the audio signal coding program is recorded, for example. Alternatively, the program may be stored into the nonvolatile memory 540 through the I/O unit 57 and a line from the hard disk drive 61 of the program (data) provider 60. Otherwise, the portable recording medium (computer readable recording medium) on which the audio signal coding program is recorded may be other recording media, such as a DVD (Digital Versatile Disk) disk and a Blu-ray Disc.

In FIG. 29, the referential marks P1 to P3 illustrate paths of the signal and data flow in each process of the audio signal coding device. As illustrated in a path P1, the audio input signal (digital data) is received into the system by the audio input unit 51, and is stored into the DRAM 53 through the bus 58 and the memory controller 52.

Moreover, as illustrated in a path P2, the digital data stored in the DRAM 53 is loaded to inside of the CPU 54 through the memory controller 52 and the bus 58, and the quantization processing (coding process) mentioned above is performed. Note that data transfer from the DRAM 53 to the CPU 54 may be performed by the DMA unit 55 other than the CPU 54.

The above-described coding process is performed by, for example, causing the CPU 54 to execute the audio signal coding program stored in the nonvolatile memory 540. The audio signal coding program is not necessarily stored in the nonvolatile memory 540 inside the CPU 54.

Furthermore, as illustrated in a path P3, the coded audio output data, i.e., for example, the AAC coded signal output from the coding unit 12 in FIG. 14 mentioned above is output to an outside device through the stream output unit 56 or the I/O unit 57.

The outside device is, for example, USB (Universal Serial Bus), SD (Secure Digital) memory card and so on, and the system receives an AAC coding stream through the I/O unit 57. The audio signal coding device illustrated in FIG. 29 is a mere example, and it is needless to say that each of examples 1 to 4 mentioned above is broadly applicable to various audio signal coding devices.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio signal coding device dividing a frequency spectrum obtained from an input audio signal to a plurality of bands, scaling and quantizing divided frequency spectra based on a scalefactor of each of the bands and a common scale which is common to the plurality of bands, and coding quantized frequency spectra, the audio signal coding device comprising:

a receiver configured to receive the input audio signal and convert the input audio signal into a digital signal with an analog to digital converter;

a band number determination unit configured to calculate a number of coding bands for coding the quantized frequency spectra; and a common scale estimation unit configured to estimate the common scale in accordance with the number of coding bands;

wherein the band number determination unit counts the band in which a quantization value is not "0" among the plurality of bands, to calculate the number of coding bands; and wherein the estimating the common scale includes dividing a number of quantization bits to be reduced by a product of a reduction characteristic and the number of coding bands, to estimate the common scale.

2. An audio signal coding method for dividing a frequency spectrum obtained from an input audio signal to a plurality of bands, scaling and quantizing divided frequency spectra based on a scalefactor of each of the bands and a common scale which is common to the plurality of bands, and coding quantized frequency spectra, the audio signal coding method comprising:

receiving the input audio signal and converting the input audio signal into a digital signal with an analog to digital converter;

calculating the number of coding bands for coding the quantized frequency spectra; and estimating the common scale in accordance with the number of coding bands;

wherein the calculating the number of coding bands includes counting the band in which a quantization value is not "0" among the plurality of bands, to calculate the number of coding bands; and wherein the estimating the common scale includes dividing a number of quantization bits to be reduced by a product of a reduction characteristic and the number of coding bands, to estimate the common scale.

3. The audio signal coding method as claimed in claim 2, wherein the calculating the number of coding bands includes counting the band in which each quantization value of the plurality of groups is not "0" with respect to the group of a plurality of subbands into which the plurality of bands are unified, to calculate the number of coding bands.

4. The audio signal coding method as claimed in claim 3, wherein the calculating the number of coding bands to the group of the plurality of subbands are performed in a second loop in which quantized frequency spectrum is coded.

5. The audio signal coding method as claimed in claim 2, wherein the calculating the number of coding bands includes obtaining the band in which the coding amount coded in each band does not fall under a certain threshold when the common scale increases, to calculate the number of coding bands.

6. The audio signal coding method as claimed in claim 5, wherein the calculating the number of coding bands includes subtracting the number of the bands in which the coding amount does not fall under the certain threshold when the common scale increases, from the number of coding bands obtained by counting the band in which the quantization value is not "0" among the plurality of bands.

7. The audio signal coding method as claimed in claim 2, wherein the calculating the number of coding bands includes obtaining the band in which the quantization value in each band does not change when the common scale increases, to calculate the number of coding bands.

8. The audio signal coding method as claimed in claim 7, wherein the calculating the number of coding bands includes subtracting the number of the bands in which each quantization value does not change when the common scale increases, from the number of coding bands obtained by counting the band in which the quantization value is not "0" among the plurality of bands.

9. An audio signal coding method for dividing a frequency spectrum obtained from an input audio signal to a plurality of bands, scaling and quantizing divided frequency spectra based on a scalefactor of each of the bands and a common scale which is common to the plurality of bands, and coding quantized frequency spectra, the audio signal coding method comprising:

receiving the input audio signal and converting the input audio signal into a digital signal with an analog to digital converter;

calculating the number of coding bands for coding the quantized frequency spectra; and estimating the common scale in accordance with the number of coding bands, wherein the estimating the common scale includes dividing a number of quantization bits to be reduced by a product of a reduction characteristic and the number of coding bands, to estimate the common scale.

10. A non-transitory computer readable medium comprising a memory for storing an audio signal coding program for dividing a frequency spectrum obtained from an input audio signal to a plurality of bands, scaling and quantizing divided frequency spectra based on a scalefactor of each of the bands and a common scale which is common to the plurality of bands, and coding quantized frequency spectra, the audio signal coding program causing a processor to execute:

receiving the input audio signal and converting the input audio signal into a digital signal with an analog to digital converter;

calculating the number of coding bands for coding the quantized frequency spectra; and estimating the common scale in accordance with the number of coding bands;

wherein the calculating the number of coding bands includes counting the band in which a quantization value is not "0" among the plurality of bands, to calculate the number of coding bands; and wherein the estimating the common scale includes dividing a number of quantization bits to be reduced by a product of a reduction characteristic and the number of coding bands, to estimate the common scale.

* * * * *